US005142108A

United States Patent [19]

Johnston et al.

[11] Patent Number: 5,142,108

[45] Date of Patent: Aug. 25, 1992

[54] SPHERE-ACTUATED FLOAT SWITCH

[75] Inventors: Stephen P. Johnston, Hawley; Gene H. Utke, Rochert; Robert G. Klabunde, Detroit Lakes, all of Minn.

[73] Assignee: S. J. Electro Systems, Inc., Detroit Lakes, Minn.

[21] Appl. No.: 678,206

[22] Filed: Apr. 1, 1991

Related U.S. Application Data

[63] Continuation-in-part of Ser. No. 540,189, Jun. 19, 1990, Pat. No. 5,087,801.

[51] Int. Cl.[5] ..... H01H 35/18

[52] U.S. Cl. ..... 200/84 R; 73/313; 200/553

[58] Field of Search ..... 417/40; 73/308, 313, 73/317, 322.5; 307/118; 340/623, 625; 200/84 R C, 61.52, 553, DIG. 29

[56] References Cited

U.S. PATENT DOCUMENTS

| | | | |
|---|---|---|---|
| 1,175,062 | 3/1916 | Johnson . | |
| 1,692,155 | 11/1928 | Brownell . | |
| 1,854,316 | 4/1932 | Teesdale . | |
| 2,291,245 | 7/1942 | Lorraine . | |
| 2,296,053 | 9/1942 | Porter et al. . | |
| 2,642,507 | 6/1953 | West . | |
| 2,832,864 | 4/1958 | Rapp . | |
| 2,833,903 | 5/1958 | Waddell . | |
| 2,949,783 | 8/1990 | Butler . | |
| 3,026,387 | 3/1962 | Ashdaugh . | |
| 3,483,341 | 12/1969 | Reichensperger . | |
| 3,518,385 | 6/1970 | Boudes et al. . | |
| 3,553,402 | 1/1971 | Hire . | |
| 3,650,347 | 3/1972 | Campos . | |
| 3,746,035 | 7/1973 | Singer . | |
| 3,753,474 | 8/1973 | Dillmann . | |
| 3,944,770 | 3/1976 | Pepper . | |
| 4,021,144 | 5/1977 | Matsusaka . | |
| 4,021,145 | 5/1977 | Pepper . | |
| 4,064,755 | 12/1977 | Bongort et al. . | |
| 4,084,073 | 4/1978 | Keener . | |
| 4,104,492 | 8/1978 | Pliml, Jr. . | |
| 4,215,975 | 8/1980 | Niedermeyer . | |
| 4,302,641 | 11/1981 | Johnston . | |
| 4,373,155 | 2/1983 | Dola . | |
| 4,378,475 | 3/1983 | McNiel . | |
| 4,540,891 | 10/1985 | Keener et al. . | |
| 4,618,746 | 10/1986 | Schwob et al. . | |
| 4,629,841 | 12/1986 | Riback et al. . | |
| 4,644,117 | 2/1987 | Grimes et al. . | |
| 4,667,069 | 5/1987 | Cholkeri . | |
| 4,692,576 | 9/1987 | Frede . | |
| 4,737,759 | 4/1988 | Stropkay et al. . | |
| 4,868,356 | 9/1989 | Lindsey | 200/83 P |
| 4,917,135 | 4/1990 | Duncan | 137/2 |
| 4,942,274 | 7/1990 | Riback et al. . | |
| 4,944,691 | 7/1990 | Marach | 439/516 |

FOREIGN PATENT DOCUMENTS

| | | |
|---|---|---|
| 595900 | 10/1925 | France . |
| 316885 | 4/1934 | Italy . |
| 146584 | 6/1954 | Sweden . |
| 198280 | 6/1938 | Switzerland . |

OTHER PUBLICATIONS

Solo-float catalog pages from Anchor Scientific Inc., 2 pages, dated Jan. 1987, (Exhibit A).

Enpo Pump Company catalog pages entitled "Liquid Level Controls For Submersible Non-Clog Pumps", 2 pages, dated May 1982 (Exhibit B).

Myers catalog page entitled "MFLC Series Mercury Free Mechanical Float Switches", 1-page, dated Mar. 1990, (Exhibit C).

*Primary Examiner*—Gerald P. Tolin

*Attorney, Agent, or Firm*—Merchant, Gould, Smith, Edell, Welter & Schmidt

[57] ABSTRACT

A sphere-actuated float switch including (i) a cage defining a longitudinal raceway, (ii) a yoke pivotally mounted externally to the cage and having first and second legs which extend into the raceway, (iii) an electrical switching means which is electrically open when the yoke is in a first position and electrically closed when the yoke is in a second position, (iii) an over-center spring capable of biasing the yoke into the appropriate electrically open and the electrically closed positions once the yoke is urged past a transition point, and (iv) a sphere within the raceway for urging the yoke between the electrically open and the electrically closed positions.

22 Claims, 16 Drawing Sheets

FIG. 1b
PRIOR ART
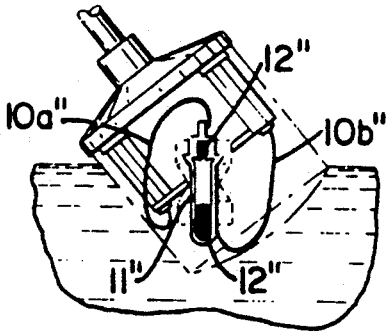
FIG. 1a
PRIOR ART
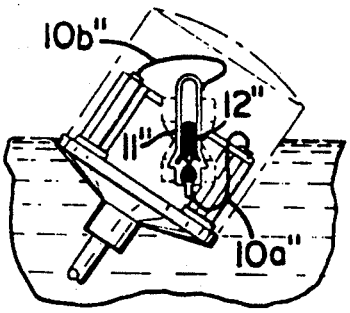
FIG. 2a
PRIOR ART
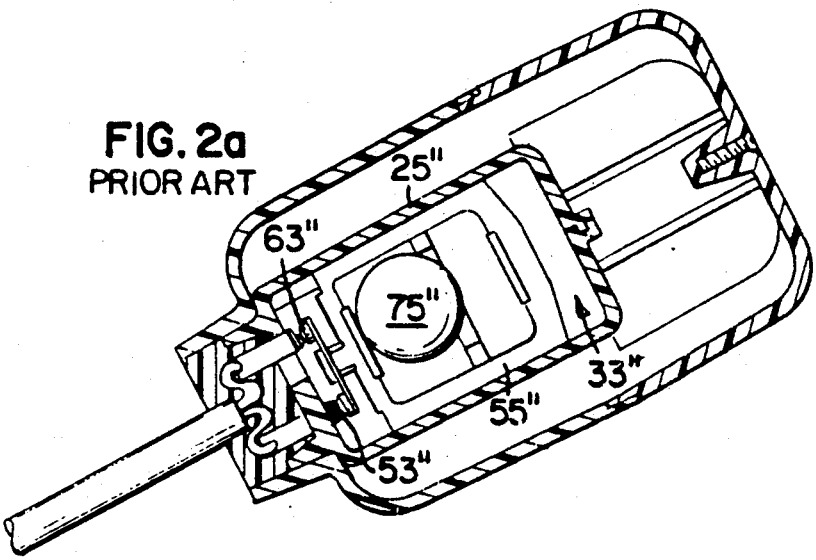
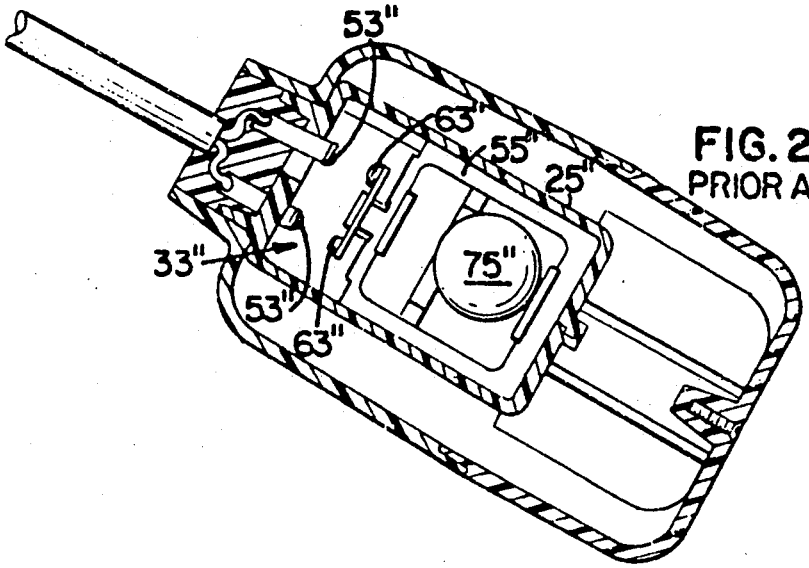
FIG. 2b
PRIOR ART FIG.5a
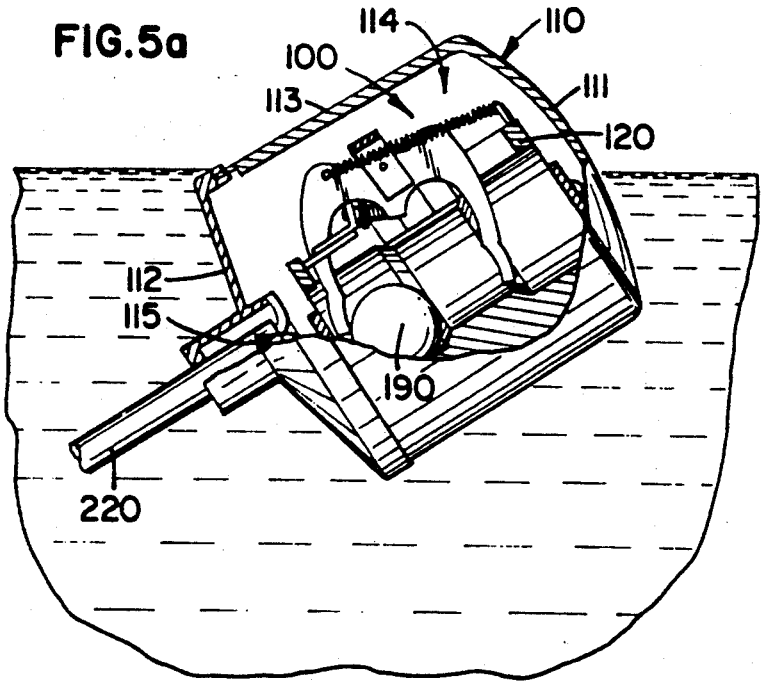
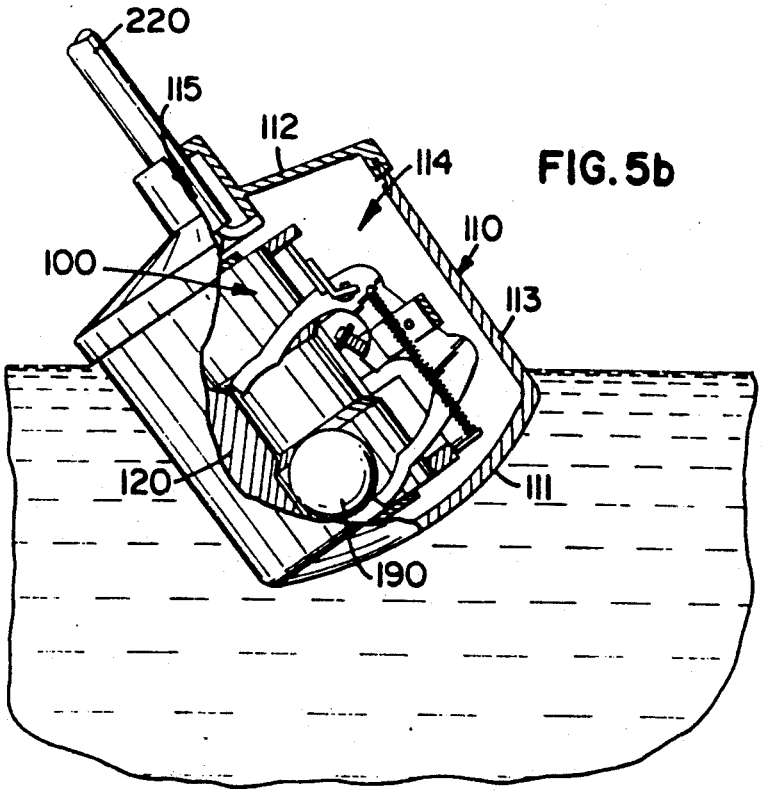
FIG.5b

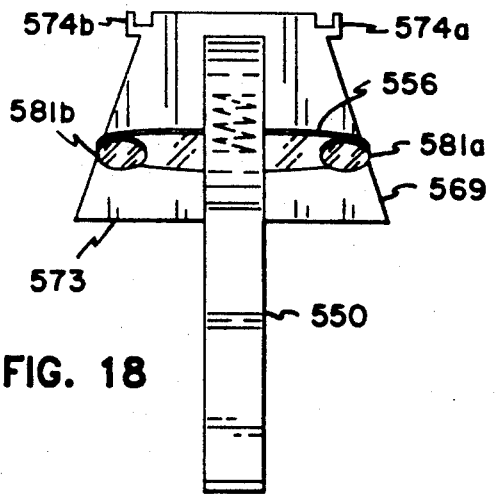
FIG. 18
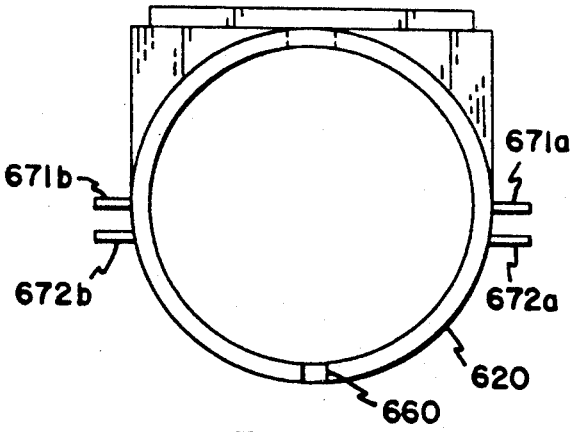
FIG. 19
FIG. 20
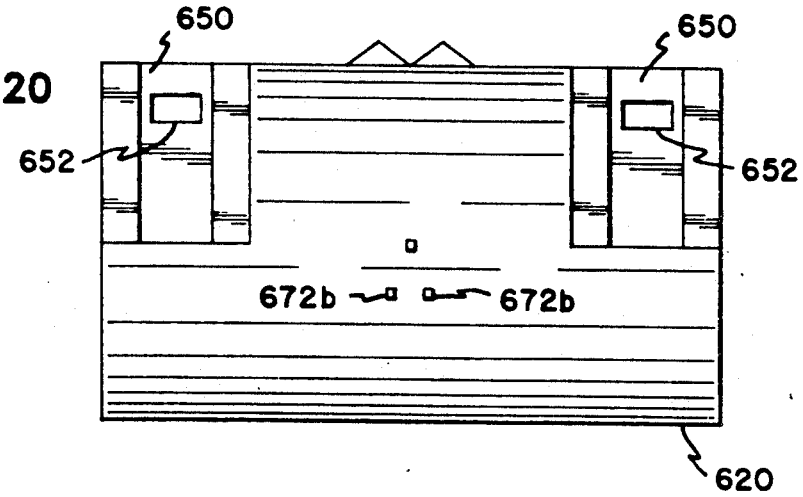
FIG. 21
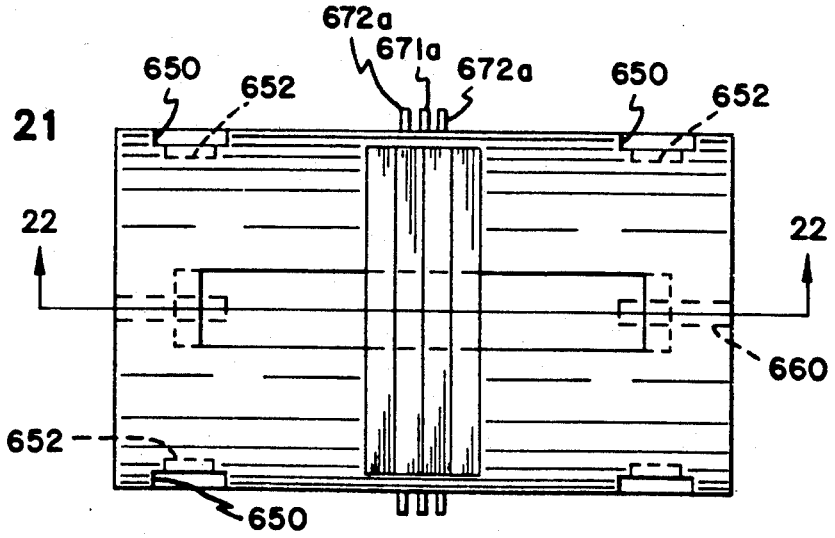

SPHERE-ACTUATED FLOAT SWITCH

This is a continuation-in-part of Ser. No. 07/540,189, filed Jun. 19, 1990 now issued as U.S. Pat. No. 5,087,801 on Feb. 11, 1992.

FIELD OF THE INVENTION

Broadly, the invention relates to float switches. Specifically, the invention relates to float switches which open and close an electrical circuit in response to the repositioning of a sphere within a raceway caused by a change in the attitude of the switch.

BACKGROUND

Many different types of float switches have been developed for opening and closing an electrical circuit in response to the level of a liquid within a reservoir. Generically, float switches includes a floating buoy and a means, responsive to the vertical position of the buoy, for alternately closing an electrical circuit when the float achieves a predetermined maximum height and opening the electrical circuit when the float achieves a predefined minimum height (normally open) or visa versa (normally closed).

One type of available float switch is known as a mercury-actuated switch. Referring to FIGS. 1*a* and 1*b*, a typical, normally open, mercury-actuated float switch includes an electrode 10*a*", 10*b*" which extend into a sealed tube 11" containing mercury 12". The mercury 12" resides at a second end of the tube 11" and electrically closes the electrode 10*a*", 10*b*" after the float switch has attained a predefined upward vertical angle caused by a high liquid level within the reservoir (FIG. 1*a*). Conversely, the mercury 12" resides at a first end of the tube 11" and leaves the electrode 10*a*", 10*b*" electrically open after the float switch has attained a predefined downward vertical angle caused by a low liquid level within the reservoir (FIG. 1*b*).

Mercury-actuated float switches provide superior switching performance. However, because of environmental concerns relating to the use of mercury, alternatives to the mercury-actuated switch are being explored.

One type of mercury-free float switch is what is known as a sphere-actuated float switch. Generally, sphere-actuated float switches utilize movement of a sphere within a raceway caused by changes in the attitude of the raceway to effectuate opening and closing of an electrical circuit.

Examples of sphere-actuated float switches are provided in U.S. Pat. No. 4,644,117 (Grimes et al.) and U.S. Pat. No. 4,629,841 (Riback et al.). Referring to FIGS. 2*a* and 2*b*, the sphere-actuated float switch of Grimes et al. includes (i) a pair of positionable electrical contacts 63" attached to a shuttle 55" which is slidably retained within a raceway 33" defined by housing 25" and (ii) a corresponding pair of stationary electrical contacts 53" which are connected to the housing 25" and extend into the raceway 33". The shuttle 55" resides at a second end of the raceway 33" and provides contact between the electrical connections 53" and 63" after the float switch has attained a predefined upward vertical angle caused by a high liquid level within the reservoir (FIG. 2*a*). Conversely, the shuttle 55" resides at a first end of the raceway 33" and prevents contact between the electrical connections 53" and 63" after the float switch has attained a predefined downward vertical angle caused by a low liquid level within the reservoir (FIG. 2*b*). Movement of the shuttle 55" within the raceway 33" is effected by a sphere 75" which rolls within the shuttle 55" based upon the attitude of the shuttle 55".

The float switch of Grimes et al. addresses the environmental concerns associated with the utilization of mercury-actuated float switches. However, the switch lacks the reliability associated with mercury-actuated float switches. Various factors contribute to this lack of reliability including specifically, but not exclusively, excessive friction between the shuttle 55" and the housing 25" resulting in failure of the sphere 75" to reposition the shuttle 55", wedging of the shuttle 55" within the raceway 33" again resulting in failure of the sphere 75" to reposition the shuttle 55", and generation of deposits upon the electrical contacts 53" and/or 63" resulting in poor electrical flow between the electrical contacts 53" and 63".

Referring to FIGS. 3*a*, 3*b* and 3*c*, the sphere-actuated float switch of Riback et al. includes (1) a longitudinally extended raceway 51" having a first longitudinal end 50" and a second longitudinal end 52" within which a sphere 54" is free to roll based upon the attitude of the raceway 51". A pivotally mounted cage 56" is positioned proximate the raceway 51" with legs 64" and 65" of the cage 56" alternately extending into the raceway 51". An actuator extension 60" extends from the cage 56" in a direction opposite the legs 64" and 65" for actuating in a direction opposite the legs 64" and 65" for actuating a microswitch 62" based upon the pivoted position of the cage 56". The cage 56" resides in a first pivoted position with the sphere 54" at the second end 52" of the raceway 51", the actuator extension 60" detached from the microswitch 62", and the microswitch 62" in an electrically open mode after the raceway 51" has attained a predefined downward vertical angle caused by a low liquid level within the reservoir (FIG. 3*c*). Conversely, the cage 56" resides in a second pivoted position with the sphere 54" at the first end 50" of the raceway 51" and the actuator extension 60" in contact with the microswitch 62" so as to place the microswitch 62" in an electrically closed mode after the raceway 51" has attained a predefined upward vertical angle caused by a high liquid level within the reservoir (FIG. 3*a*). Pivoting of the cage 56" is effected by movement of sphere 54" between the first 50" and second 52" ends of the raceway 51". A locking mechanism (not shown) is employed to lock the cage 56" and movement of the sphere 54". The locking mechanism releases the cage 56" to pivot between the first and second positions only when the sphere 54" depresses a pressure plate 86" which extends into the raceway 51".

The float switch of Riback et al., as with the float switch of Grimes et al., addresses the environmental concerns associated with mercury-actuated switches but lacks the reliability associated with mercury-actuated float switches. Various factors contribute to the lack of reliability including specifically, but not exclusively, insufficient momentum to effect a clean repositioning of the cage 56" and loss of synchronization between movement of the cage 56" and the sphere 54". In addition, the float switch of Riback et al. utilizes a microswitch to effectuate opening and closing of the electrical circuit based upon movement of the cage 56" rather than direct electrical contact.

Accordingly, a substantial need exists for a reliable, mercury-free float switch which can directly provide effective opening and closing of an electrical circuit under heavy electrical load conditions.

SUMMARY OF THE INVENTION

The invention is directed to a reliable float switch which includes (i) a cage defining a longitudinal raceway, (ii) a yoke which is pivotally mounted externally to the cage and having first and second legs which extend into the raceway, (iii) a biasing means capable of biasing the yoke in a first direction when the yoke is in a first longitudinal position and biasing the yoke in a second longitudinal direction, which is substantially diametrically opposed to the first direction, when the yoke is in a second position, (iv) an electrical switching means which is electrically open when the yoke is in the first position and electrically open when the yoke is in the second position, and (v) a means for urging the yoke between the first and second positions against the bias of the biasing means based upon the longitudinal angle of the raceway.

The float switch may optionally, or in the alternative, include a second electrical switching means which is electrically closed when the yoke is in the first position and electrically opened when the yoke is in the second position.

The float switch operates to control the flow of electricity through a circuit by cycling through the steps of (i) urging an electrically open pair of electrical contacts toward an electrically closed position, (ii) biasing the pair of electrical contacts toward an electrically closed position once urging of the electrical contacts towards the electrically closed position proceeds past a transitional position, (iii) electrically closing the electrical contacts, (iv) urging the electrically closed pair of electrical contacts towards an electrically open position, (v) biasing the pair of electrical contacts toward an electrically open position once urging of one of the electrical contacts towards the electrically open position proceeds past the transitional position, and (vi) electrically opening the electrical contacts.

BRIEF DESCRIPTION OF THE DRAWINGS

FIG. 1*a* depicts a prior art mercury-actuated float switch in an electrically closed position.

FIG. 1*b* depicts the prior art mercury-actuated float switch of FIG. 1*a* in an electrically open position.

FIG. 2*a* depicts the prior art sphere-actuated float switch disclosed in U.S. Pat. No. 4,644,117 (Grimes et al.) in an electrically closed position.

FIG. 2*b* depicts the prior art sphere-actuated float switch of 2*a* in an electrically open position.

FIG. 5*a* is an elevational side view of one embodiment of the invention in an electrically closed position with a portion thereof broken away to facilitate viewing of the switch.

FIG. 5*b* depicts the invention embodiment depicted in FIG. 5*a* in an electrically open position.

FIG. 18 is a right end view of the yoke shown in FIGS. 17*a* and 17*b*.

FIG. 19 is a right end view of a further alternative improved embodiment of a switch body or cage without contacts mounted to the cage.

FIG. 20 is a side view of the cage depicted in FIG. 19.

FIG. 21 is a top view of the cage depicted in FIG. 20.

DETAILED DESCRIPTION OF THE PREFERRED EMBODIMENTS

Figure 4:
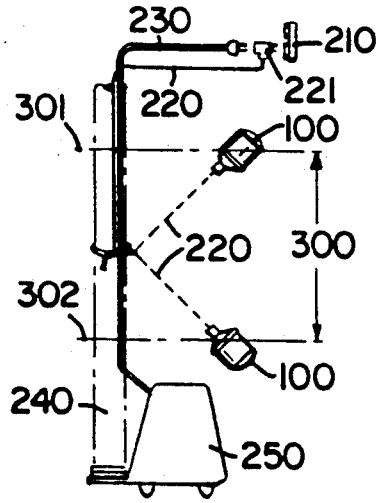
FIG. 4 is a schematic view of a float switch controlled pumping system.
Figure 3C:
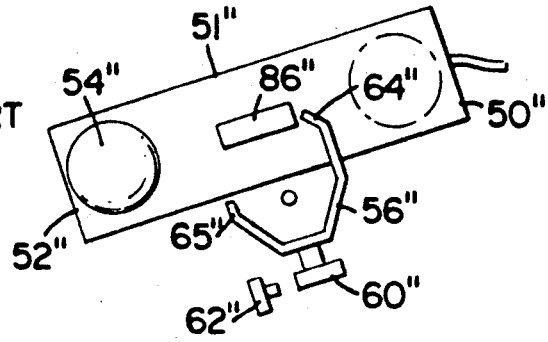
FIG. 3c PRIOR ART
FIG. 3*c* depicts the prior art sphere-actuated float switch of FIG. 3*a* in an electrically open position.
Figure 3B:
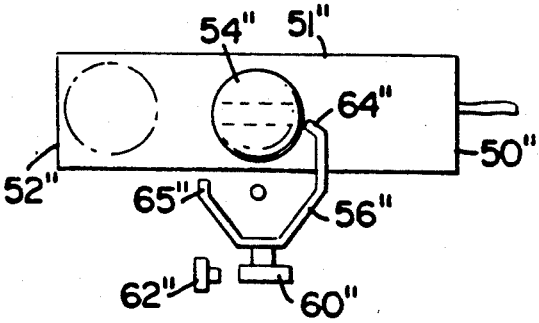
FIG. 3b PRIOR ART
FIG. 3*b* depicts the prior art sphere-actuated float switch of FIG. 3*a* in a transitional position.
Figure 3A:
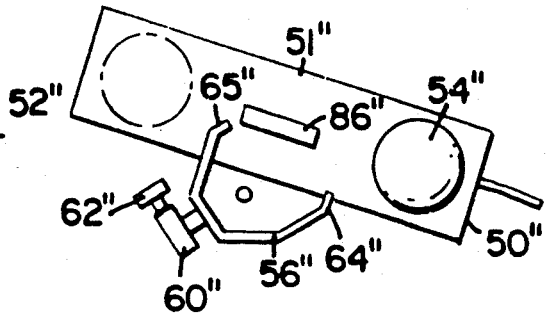
FIG. 3a PRIOR ART
FIG. 3*a* depicts the prior art sphere-actuated float switch disclosed in U.S. Pat. No. 4,629,841 (Riback et al.) in an electrically closed position.
Figure 6:
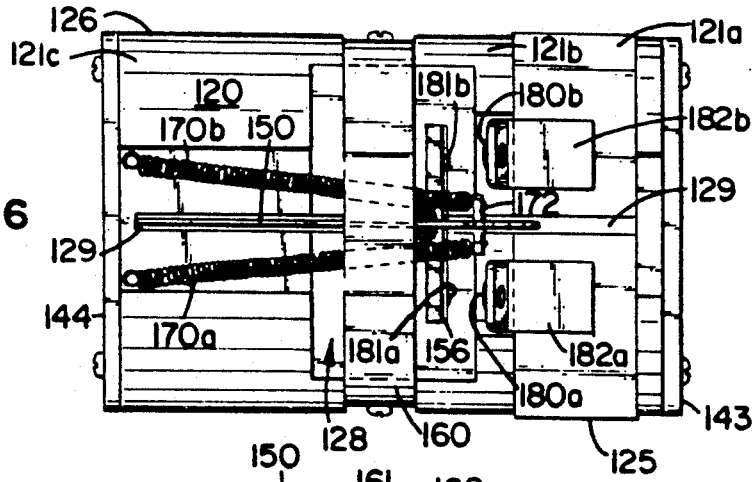
FIG. 6 is a top view of the switch depicted in FIGS. 5*a* and 5*b*.
Figure 7:
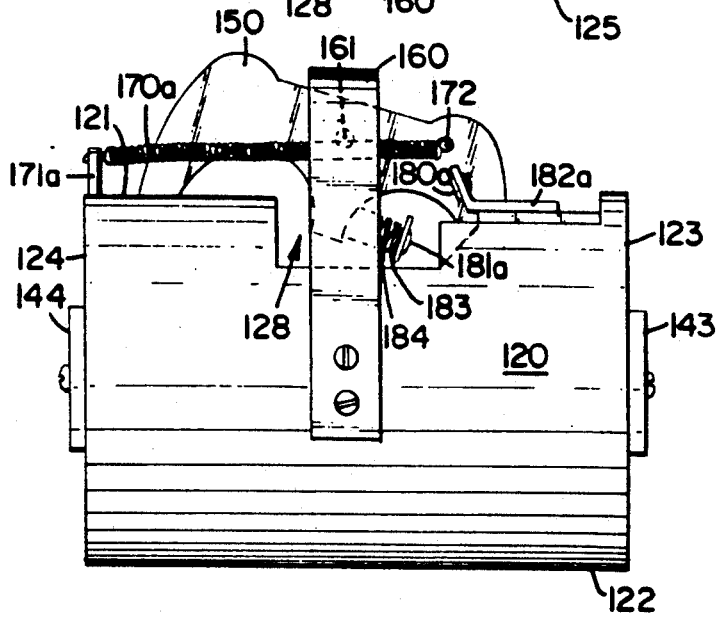
FIG. 7 is a side view of the switch depicted in FIG. 6.
Figure 8:
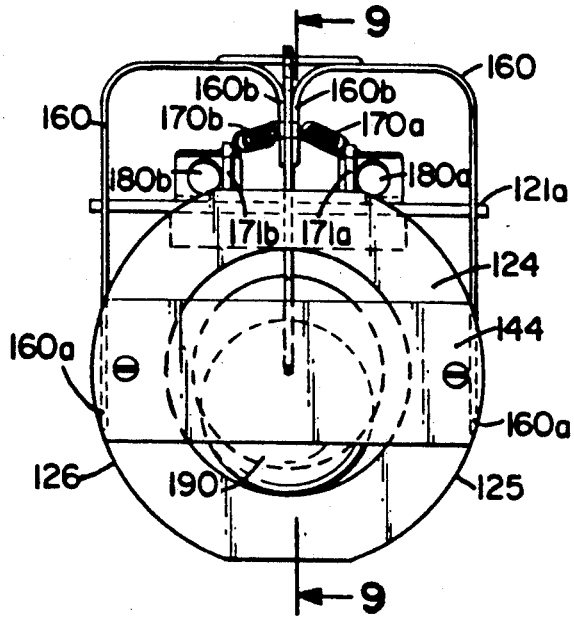
FIG. 8 is a front view of the switch depicted in FIG. 7.

Referring now to FIGS. 6, 7, 8, 9*a* and 9*b*, the core of the switch 100 is a cage 120 which defines a substantially cylindrical longitudinal raceway 130 extending from the front 123 to the back 124 of the cage 120. The inner surface 127 of the cage 120 defining the raceway 130 includes (i) substantially identical front 127*a* and rear 127*e* portions which define substantially identical front 130*a* and rear 130*e* cylindrical retention portions, (ii) a central portion 127*c* between the front 127*a* and rear 127*e* retention portions which defines a central transitional portion 130*c*, (iii) a front inclined portion 127*b* between the front 127*a* and central 127*c* portions, and (iv) a rear inclined portion 127*d* between the rear 127*e* and central 127*c* portions.

The inclined portions 127*b* and 127*d* of the inner surface 127 provide a barrier which retards movement of the sphere 190 out of the front 130*a* and rear 130*e* retention portions of the raceway 130. The inclined portions 127*b*,127*d* of the inner surface 127 generates potential energy within the sphere 190 as the longitudinal angle of the raceway 130 changes and begins to urge the sphere 190 towards the other end 123,124 of the cage 120. Once the longitudinal angle is sufficient to permit the sphere 190 to roll past the inclined portion 127*b* or 127*d* which is retarding movement of the sphere 190, the sphere 190 readily proceeds through the central portion 130*c* of the raceway 130 and into the retention portion 130*a* or 130*e* of the raceway 130 at the other end 123, of the cage 120.

Front 143 and rear 144 cover plates are respectively coupled to the front 123 and rear 124 of the cage 120 over the raceway 130 in order to prevent continued longitudinal movement to the sphere 190 out of the longitudinal raceway 130.

A U-shaped yoke 150 is pivotally mounted above the top 121 of the cage 120 by means of a pair of J-shaped brackets 160. The long leg 160*a* of one bracket 160 is connected to the right side 125 of the cage 120 while the long leg 160*a* of the other bracket 160 is connected to the left side 126 of the cage 120. The brackets 160 extend upwardly from the sides 125,126 of the cage 120 with the short legs 160*b* of the brackets 160 facing one another above the cage 120. The center of the yoke 150 is sandwiched between and pivotally connected to the short legs 160*b* of the brackets 160 by means of a center pin 161.

The front 153 and rear 154 legs of the yoke 150 extend into the longitudinal raceway 130 through a longitudinal slit 129 in the top 121 of the cage 120. The legs 153,154 extend a sufficient distance into the longitudinal raceway 130 to insure that the sphere 190 remains between the legs 153,154 at all times.

Figure 9A:
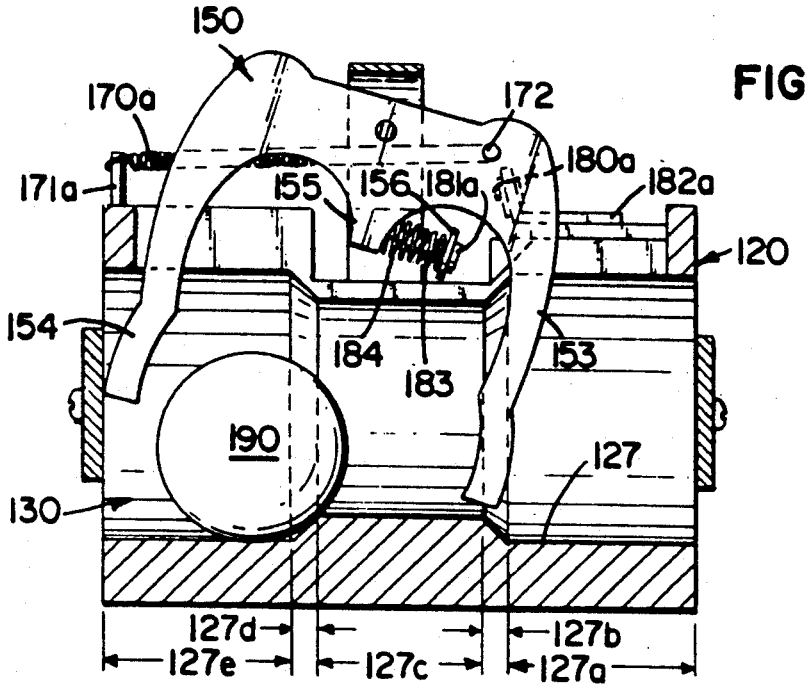
FIG. 9*a* is a cross-sectional view of the switch depicted in FIG. 8 taken along line 9—9 depicting the switch in an electrically open position.
Figure 9B:
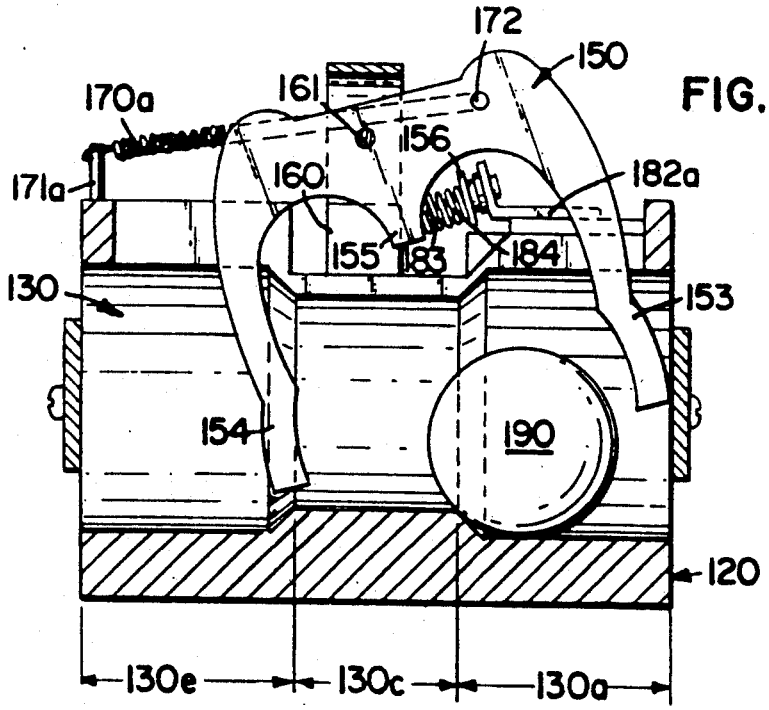
FIG. 9*b* depicts the switch of FIG. 9*a* in an electrically closed position.

Longitudinal movement of the sphere 190 within the raceway 130 between the front 130*a* and rear 130*e* portions of the raceway 130 causes the sphere 190 to strike the legs 153,154 of the yoke 150 and pivot of the yoke 150 between a first pivot position and a second pivot position depicted in FIGS. 9*a* and 9*b*.

A front pair of right and left stationary electrical contacts 180*a*,180*b* are separately mounted upon the top 121 of the cage 120 by a pair of L-shaped mounting brackets 182*a*,182*b*. The front pair of electrical contacts 180*a*,180*b* face the rear 124 of the cage 120 and extend over a lateral channel 128 in the top 121 of the cage 120.

A front pair of right and left positionable electrical contacts 181*a*,181*b* are mounted upon opposite ends of a lateral extension bar 156 which is connected to a central projection 155 on the yoke 150. The central projection 155 extends between the legs 153,154 of the yoke 150 into the lateral channel 128 in the top 121 of the cage 120. The front pair of positionable electrical contacts 181*a*,181*b* are configured in conjunction with the front pair of stationary electrical contacts 180*a*,180*b* so as to provide an electrical connection of the corresponding right 180*a*,181*a* and left 180*b*,181*b* electrical contacts when the yoke is in one pivoted position and prevent electrical connection of the corresponding right 180*a*,181*a* and left 180*b*,181*b* electrical contacts when the yoke is in the other pivoted position.

The laterally extending channel 128 on the top 121 of the cage 120 is provided with sloped front and rear walls (unnumbered) to permit arcuate movement of the front positionable electrical contacts 181*a*,181*b* between the electrically open and electrically closed positions.

The lateral extension bar 156 is reciprocally mounted onto the center projection 155 of the yoke 150 by means of an extension shaft 183. A spring 184 is provided around the extension shaft 183 and retained between the lateral extension bar 156 and the center projection 155 for biasing the front positionable electrical contacts 181*a*,181*b* towards the front stationary electrical contacts 180*a*,181*b*. Biasing of the front positionable electrical contacts 181*a*,181*b* towards the front stationary electrical contacts 180*a*,180*b*, assists in assuring effective contact between the positionable 181*a*,181*b* and stationary 180*a*,180*b* contacts when the yoke 150 is in the first pivotable position.

The first electrical cord 220 connected to the float switch 100 includes a live wire (unnumbered) and a return wire (unnumbered) with the live wires coupled to the front right stationary electrical contact 180*a* and the return wire connected to the front left stationary electrical contact 180*a*. Flow of electricity is provided from the live wire to the return wire so as to complete the electrical circuit by simultaneously coupling the front right stationary electrical contact 180*a* to the right positionable electrical contact 181*a* and the front left stationary electrical contact 180*b* to the left positionable electrical contact 181*b*. Such coupling of the front electrical contacts 180*a*,180*b*,181*a*,181*b* permits electricity to sequentially flow from the live wire to the return wire through (i) the front right stationary electrical contact 180*a*, (ii) the front right positionable electrical contact 181*a*, (iii) the lateral extension bar 156, (iv) the front left positionable electrical contact 181*b*, and (v) the front left stationary electrical contact 180*b*.

Biasing of the yoke 150 towards the appropriate first or second pivotable positions is provided by a pair of longitudinal springs 170*a*,170*b* which are coupled at a first end (unnumbered) to the cage 120 proximate the back 124 of the cage 120 and at a second end (unnumbered) to the yoke 150 between the pivot point 161 and the front 123 of the cage 120. The springs 170*a*,170*b* are connected to the cage 120 by means of a pair of vertical posts 171*a*,171*b* and connected to the yoke 150 by means of a laterally extending connector pin 172. The springs 170*a*,170*b* are vertically positioned with respect to the pivot point 161 so as to provide biasing of the yoke 150 to remain in the first pivotable position when the yoke 150 is in the first pivotable position and biasing of the yoke 150 to remain in the second pivotable position when the yoke 150 is in the second pivotable position. Such a dual biasing effect is obtained by vertically positioning the springs 170*a*,170*b* so that the springs 170*a*,170*b* pass through the axis of the pivot point 161 as the yoke 150 moves between the first and second pivotable positions. Referring to FIGS. 9*a* and 9*b*, the springs 170*a*,170*b* bias the yoke 150 towards the front 123 of the cage 120 when the yoke 150 is in a first pivoted position (springs 170*a*,170*b* above pivot point 161) and bias the yoke 150 towards the back 124 of the cage 120 when the yoke 150 is in a second pivoted position (springs 170*a*,170*b* below pivot point 161).

The cage 120, cover plates 143,144, yoke 150, and brackets 160 may be constructed from substantially any structural material possession sufficient structural integrity regardless of electrical conductivity including specifically, but not exclusively, plastics such as polyester and polyvinyl chloride and metals such as aluminum and steel.

Proper functioning of the switch 100 requires that the force exerted upon the yoke 150 by the sphere 190 in the longitudinal direction when the sphere 190 strikes one of the legs 153,154 will always be sufficient to overcome a combination of the longitudinal biasing force applied to the yoke 150 by the springs 170*a*,170*b* and the frictional forces acting upon the yoke 150.

The longitudinal force applied to the yoke 150 by the sphere 190 is attributable to a combination of the longitudinal momentum of the sphere 190 when the sphere 190 strikes the yoke 150 and the linear distance between the point at which the sphere 190 contacts the yoke 150 and the pivot point 161 of the yoke 150. The momentum of the sphere 190 when the sphere 190 strikes the yoke 150 is dictated by the mass of the sphere 190 and the velocity of the sphere 190 when the sphere 190 strikes the yoke 150. Because movement of the sphere is based upon gravity, the velocity of the sphere 190 when the sphere 190 strikes the yoke 150 is dictated by the vertical distance traveled by the sphere 190 prior to striking the yoke 150. The vertical distance traveled by the sphere 190 prior to striking the yoke 150 is the vertical distance between the restraining inclined surface 127*b* or 127*d* and the point at which the sphere 190 contacts the yoke 150. The vertical distance between the restraining inclined surface 127*b*,127*d* and the point at which the sphere 190 contacts the yoke 150 is a function of the linear distance between these two points and the vertical angle achieved by the raceway 130 prior to release of the sphere 190. The vertical angle achieved by the raceway 130 prior to release of the sphere 190 is dictated by the angle of the restraining inclined surface 127*b* or 127*d*.

Accordingly, in the final analysis, the longitudinal force applied to the yoke 150 by the sphere 190 depends upon a combination of (i) the linear distance between the point at which the sphere 190 contacts the yoke 150 and the pivot point 161 of the yoke 150, (ii) the linear distance between the restraining inclined surface 127*b*,127*d* and the point at which the sphere 190 contacts the yoke 150, (iii) the angle of the restraining inclined surface 126*b*,127*d*, and (iv) the mass [size and density] of the sphere 190.

The yoke 150 should be constructed with a linear distance of at least about 2 cm and most preferably about 3 to about 6 cm between the point at which the sphere 190 contacts the yoke 150 and the pivot point 161 of the yoke 150 in order to provide effective repositioning force to the yoke 150 without constructing an unwieldy switch.

Likewise, the raceway 130 should be constructed to retain the sphere 190 and the yoke 150 at a linear distance of at least about 1 cm and most preferably about 2 to about 5 cm until the sphere 190 is released in order to provide effective repositioning force to the yoke 150 without constructing an unwieldy switch.

The inclined surfaces 127*b*,127*d* are preferably angled such that the raceway 130 must achieve a vertical angle of at least about 10° most preferably about 30° to about 60°, before releasing the sphere 190. Angles of less than about 10° are difficult to consistently obtain under normal operation conditions and can result in failure of the switch 100.

The sphere 190 should be constructed from a fairly dense material in order to maximize the momentum available to reposition the yoke 150 against the bias of the springs 170*a*,170*b*. Accordingly, the sphere 190 is preferentially constructed from such materials as steel or iron.

Figure 10:
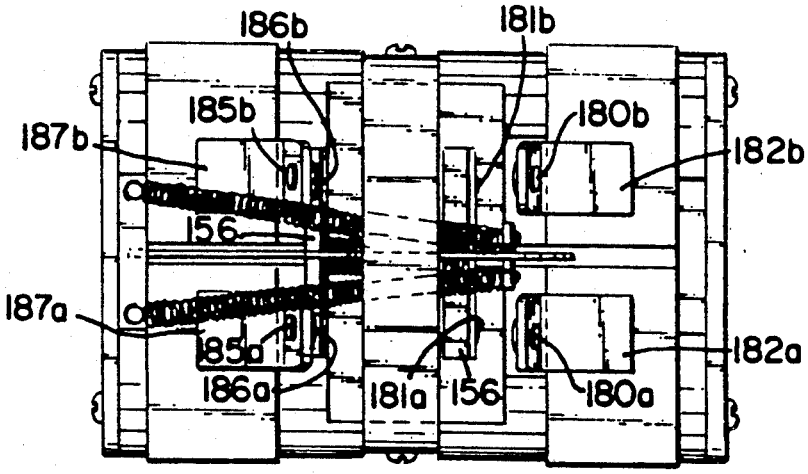
FIG. 10 is a top view of a second embodiment of the invention.
Figure 11A:
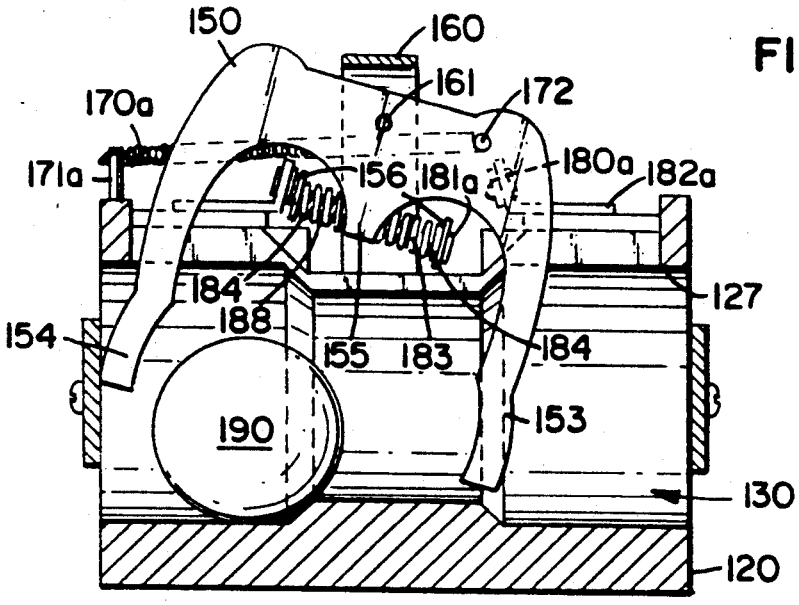
FIG. 11*a* is a cross-sectional view of the switch depicted in FIG. 10 taken along line 11—11 with the switch in a first position.
Figure 11B:
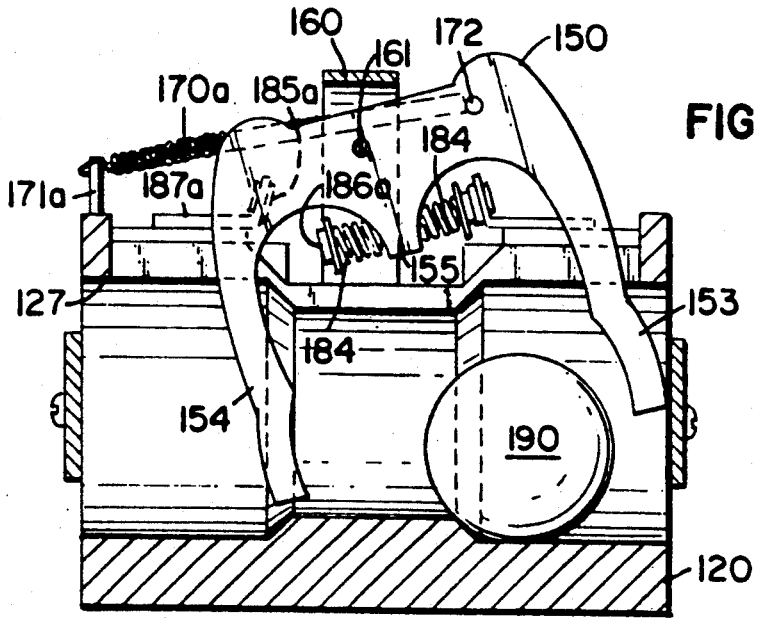
FIG. 11*b* is depicts the switch of FIG. 11*a* in a second electrical position.

Referring to FIGS. 10, 11*a* and 11*b*, an alternative embodiment of the float switch 100 further includes a rear pair 185*a*,185*b* of stationary electrical contacts and a corresponding rear pair of positionable electrical contacts 186*a*,186*b* which are simply mirror images of the front set 180*a*,180*b*,181*a*,181*b*. The rear set of electrical contacts 185*a*,185*b*,186*a*,186*b* are electrically opened and closed in direct opposition to the front set 180*a*,180*b*,181*a*,181*b* such that when one set is electrically closed the other set will be electrically open.

The pumping range 300 is dictated by a combination of the angle of the inclined surface portions 126*b*,127*d* and the length of cord 220 provided between the stand pipe 240 and the float switch 100.

Referring to FIGS. 5*a* and 5*b*, the switch 100 is sealed within a chamber 114 defined by a substantially cylindrical housing 110. The switch 100 is configured within the housing 110 so that the raceway 130 longitudinally extends from the top 111 to the bottom 112 of the housing 110 and the sphere 190 will roll between the front portion 130*a* and the rear portion 130*e* of the raceway 130 based upon the relative heights of the top 111 and bottom 112 of the housing 110. A dual wire electrical cord 220 extends into the housing 110 and into contact with the front stationary electrical contacts 180*a*,180*b* through an orifice 115 in the base 112 of the housing 110.

The switch 100 may be employed to control various electrical equipment based upon the level of a liquid within a reservoir. FIG. 4 depicts use of the switch 100 to control a submersible pump 250. The switch 100 is connected to a source of electricity 210 by a first electrical cord 220 with a piggy back plug 221. The pump 250 is connected to the source of electricity 210 by a second electrical cord 230 which is plugged into the piggy back plug 221. Flow through the piggy back plug 221 to the second cord 230 is controlled by the float switch 100 which is electrically open to prevent the flow of electricity to the pump 250 after the float switch 100 reaches the lowest point 302 of the pumping range 300 and is electrically closed to permit the flow of electricity to the pump 250 after the float switch 100 reaches the highest point 301 of the pumping range 300.

In operation of switch 100, a liquid level within the reservoir which is at or below the bottom 302 of the pumping range 300 causes switch 100 to occupy a downward position such as depicted in FIG. 5*b*. In the downward position, (i) the switch 100 is electrically open, (ii) the sphere 190 is retained within the rear retention portion 130*e* of the raceway 130, (iii) the yoke 150 is in the second pivotable position towards the rear 124 of the cage 120, and (iv) the springs 170*a*,170*b* bias the yoke towards the rear 124 of the cage 120. As the liquid level increases, the raceway 130 angles upward past horizontal until the sphere 190 rolls forward the front 121 of the cage and into contact with the rear inclined surface 127*d*. Further increases in the liquid level causes the switch 100 to reach the top 301 of the pumping range 300 at which time the sphere 190 rolls over the rear inclined surface 127*d*, through the central transitory portion 130*c* of the raceway 130, into contact with the front leg 153 of the yoke 150 so as to pivot the yoke 150 past a transitional pivot position, and into the front retention portion 130*a* of the raceway 130. Once the yoke has been pivoted past the transitional pivot position, the springs 170*a*,170*b* complete repositioning of the yoke 150 into the first pivotable position as they are then positioned to bias the yoke toward the front 121 of the cage 120 and into the first pivotable position. In the first pivotable position the switch 100 is electrically closed with the front positionable electrical contacts 181*a*,181*b* coupled to the front stationary electrical contacts 180*a*,180*b* and retained in the closed position by the springs 170*a*,170*b*.

Movement of the switch 100 from electrically closed to electrically opened is simply a reverse of the described sequence with the sphere 190 moving from the front retention portion 130*a* of the raceway 130 to the rear retention portion 130*e* and the yoke pivoting from the first pivotable position proximate the front 123 of the cage 120 to the second pivotable position proximate the rear 124 of the cage 120.

Further improvements have been made to the embodiments of the switch 100 disclosed in detail above and illustrated in FIGS. 5–11. The description which follows provides a detailed description of the improvement made to the switch previously disclosed. FIGS. 12–29 illustrate embodiments of improved switches and switch housings in accordance with the principles of the present invention.

Referring to FIGS. 12*a*, 12*b*, 13, 14, 15, 16*a* and 16*b*, switch 400 and switch housing 410 is shown. The core of the switch 400 is a switch body, or cage 420, which defines a substantially cylindrical longitudinal raceway 430 extending from the front 423 to the back 424 of the cage 420. An inner surface 427 of the cage 420 defining the raceway 430 includes substantially identical front 427*a* and rear 427*e* surface portions which define substantially identical front 430*a* and rear 430*e* cylindrical retention portions.

Figure 16A:
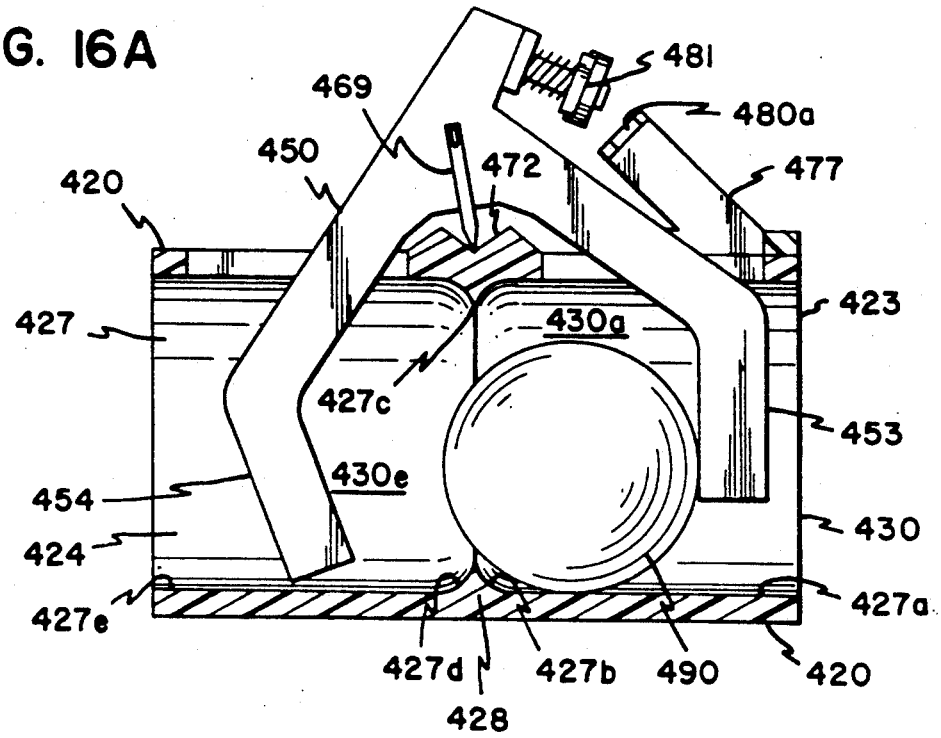
FIG. 16*a* is a partial cross-sectional side view of the switch depicted in FIG. 15 depicting the switch in the electrically open position.
Figure 16B:
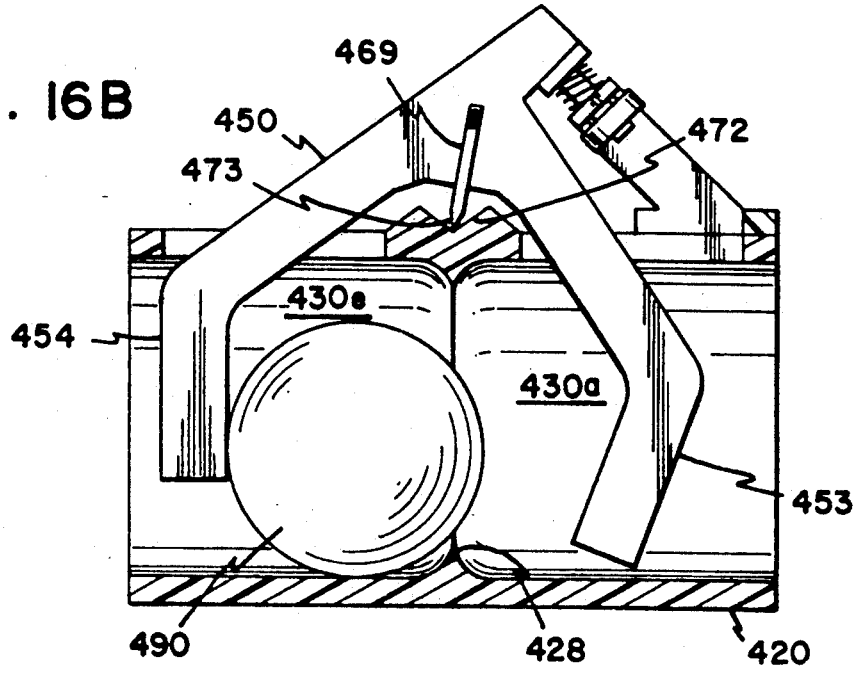
FIG. 16*b* depicts the switch of FIG. 16*a* in the electrically closed position.

As best shown in FIGS. 16*a* and 16*b*, a central portion 427*c* is located at generally a midpoint of the longitudinal raceway 430. Front inclined surface portion 427*b* and rear inclined surface portion 427*d* extend from the front surface portion 427*a* and the rear surface portion 427*e*, respectively, and terminate at the central portion 427*c*. The rear inclined surface portion 427*d* and the front inclined surface portion 427*b* cooperate with the central portion 427*c* to form a barrier 428.

The inclined surface portions 427*b*,427*d* separate the cage into the two compartments or retention portions 430*a* and 430*e*. The barrier 428 retards movement of the sphere 490 out of the front 430*a* or rear 430*e* retention portions to the other retention portion of the raceway 430. The barrier 428 has a height which prevents movement of the sphere 490 from one of the retention portions 430*a*,430*e* to the other retention portion when the longitudinal angle of the raceway 430 is less than or equal to a threshold angle. The longitudinal angle of the raceway 430 refers to the angle of a longitudinal axis defined by the raceway 430 with respect to the horizontal axis. The barrier 428 permits movement of the sphere from one retention portion to the other when the longitudinal angle is greater than the threshold angle.

In operation, as the longitudinal angle of the raceway 430 changes and begins to urge the sphere 490 from one end 423,424 toward the other end of the cage 420, the sphere 490 will engage one of the inclined surface portions 427*b*,427*d* of the barrier 428. Once the longitudinal angle of the cage 420 has passed the threshold angle, the sphere 490 rolls over the inclined surface portion 427*b* or 427*d* and central portion 427*c* which is retarding movement of the sphere 490 and the sphere 490 proceeds into the retention portion 430*a* or 430*e* of the raceway 430 at the other end of the cage 420. A front yoke stop 443 and a rear yoke stop 444 protruding from the housing 410 prevent continued longitudinal movement of the sphere 490 out of the longitudinal raceway 430 by engaging yoke legs 453,454, respectively.

In the preferred embodiment, barrier 428 extends circumferentially around the inner surface 427 of raceway 430. This permits an infinite number of orientations for mounting of switch 400 about the longitudinal axis of the raceway 430. In other words, switch 400 is omnidirectional about the longitudinal axis.

The barrier 428 can be provided with different heights and lengths to change the threshold angle. It can be appreciated that barrier 428 can have different configurations to provide for different threshold angles for (1) movement of the sphere 490 from the front retention portion 430*a* to the rear retention portion 430*e*, and (2) movement of the sphere 490 from the rear retention portion 430*e* to the front retention portion 430*a*. In other words, the threshold angle for the front retention portion 430*a* is different from the threshold angle of the rear retention portion 430*e*. Different threshold angles, or non-symmetrical threshold angles, permits different activation and deactivation angles. Barrier 428 can be provided with different configurations by changing the height and/or the length of the front and rear inclined surface portions 427*c*,427*d*.

As best shown in FIGS. 16*a* and 16*b*, the central portion 427*c* has a much smaller surface extending in the longitudinal direction of the longitudinal raceway 430 compared to the central portion 127*c* of switch 100, as is best shown in FIGS. 9*a* and 9*b*. Because the barrier between retention portions 430*a*,430*e* is shortened in length, a more compact switch design along the longitudinal direction of the switch is possible. The improved switch 400 emphasizes the weight of the sphere 490 to move the yoke 450 between positions, rather than relying on the build up of speed of the sphere within the cage to activate the yoke. Preferably, the weight of the sphere 490 is greater than or equal to a weight sufficient to urge the yoke between positions against the biasing means when the longitudinal angle of the longitudinal raceway 430 is greater than a threshold angle.

By emphasizing mere weight of the sphere 490 over speed build up, switch performance may be improved in applications having turbulent liquid. In some instances, it has been found that turbulent liquid may decrease non-mercury switch performance by preventing a sphere or other rolling or sliding weight from gaining sufficient speed between positions to activate the switch. In the improved switch 400, switch performance is believed to be improved in applications having turbulent liquid since the weight of the sphere 490 alone is sufficient to move the yoke 450 between positions. Once the threshold angle is exceeded, the sphere 490 activates the switch.

Figure 12A:
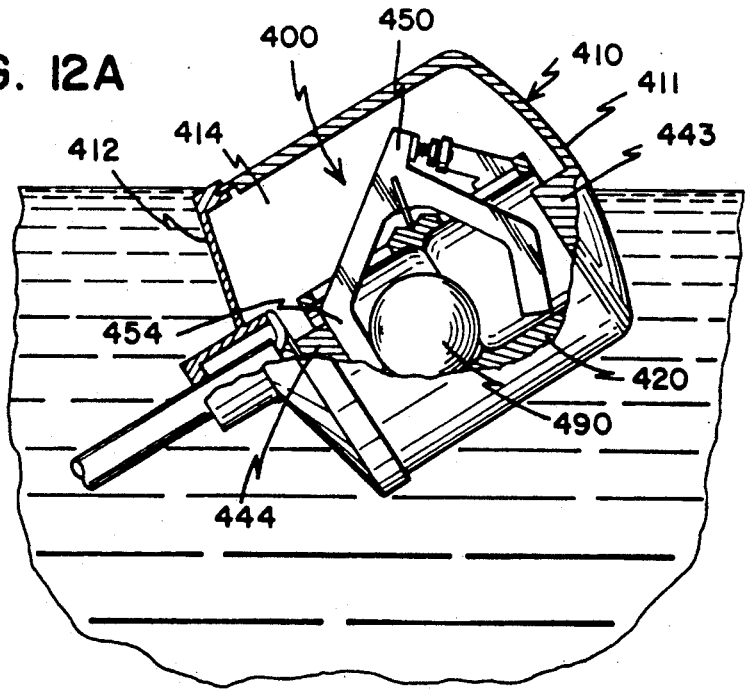
FIG. 12*a* is an elevational side view of an improved embodiment of the invention in an electrically closed position, with a portion thereof broken away to facilitate viewing of the switch and the switch housing.
Figure 12B:
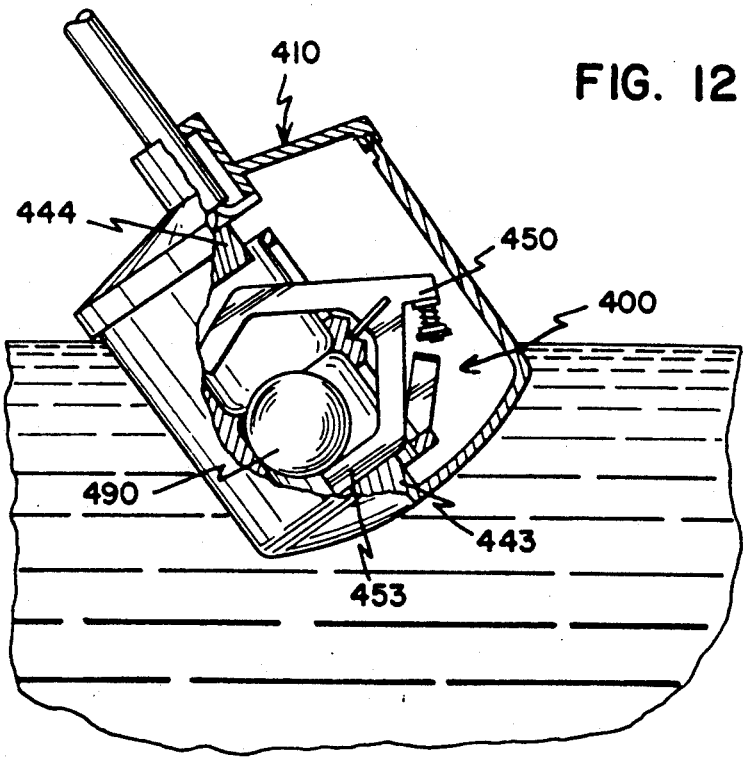
FIG. 12*b* depicts the invention embodiment depicted in FIG. 12*a* in an electrically open position.
Figure 13:
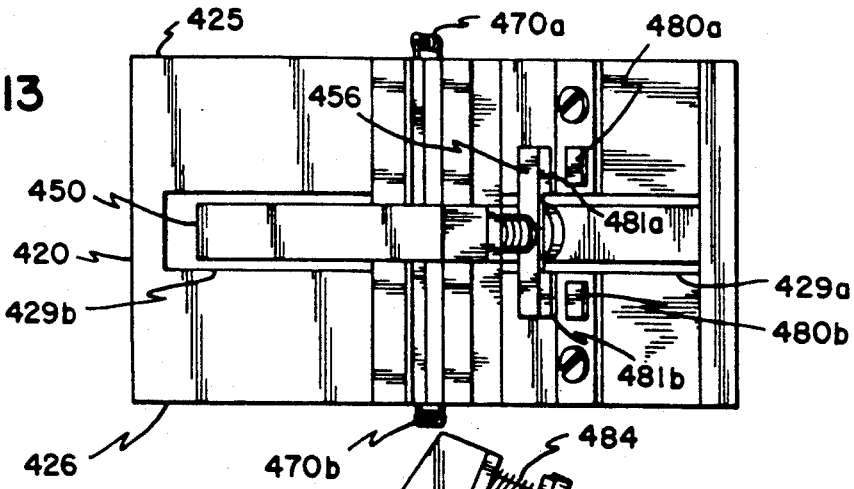
FIG. 13 is a top view of the switch depicted in FIGS. 12*a* and 12*b* in the electrically open position.

Referring to FIGS. 12*a* and 12*b*, the improved switch 400 is sealed within a chamber 414 defined by the substantially cylindrical float housing, or switch housing, or housing 410. The switch 400 is configured within the housing 410 so that the raceway 430 longitudinally extends from the bottom 412 to the top 411 of the housing 410 and the sphere 490 will roll between the front retention portion 430*a* and the rear retention portion 430*e* of the raceway 430 based on the relative heights of the top 411 and the bottom 412 of the housing 410. Housing 410 has a generally cylindrical shape. Housing 410 also has a compact design for use in applications where a small sized float housing is desirable or required.

Figure 27:
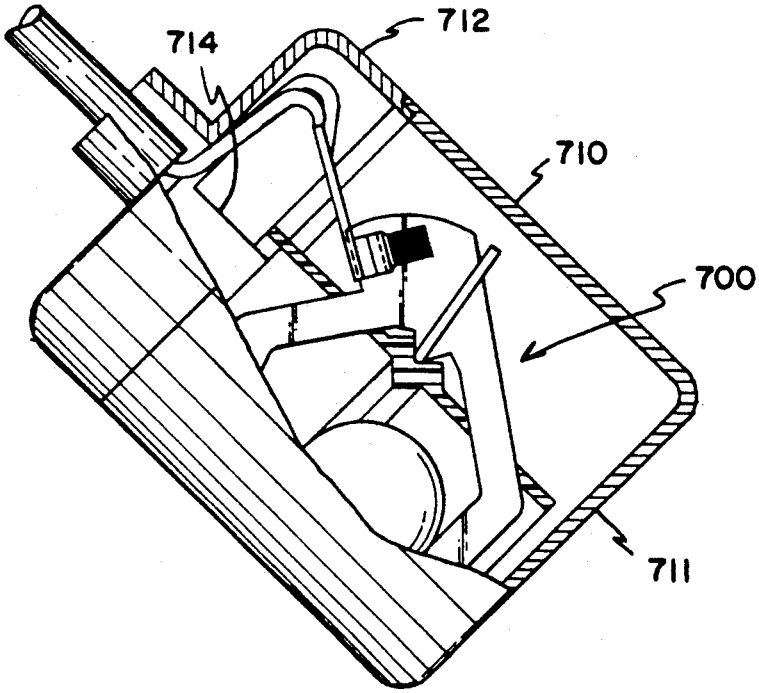
FIG. 27 is an elevational side view of a further improved embodiment of the invention showing an improved float housing, or switch housing, with a switch having contacts on an opposite end to the position shown in FIGS. 12*a* and 12*b*.
Figure 28:
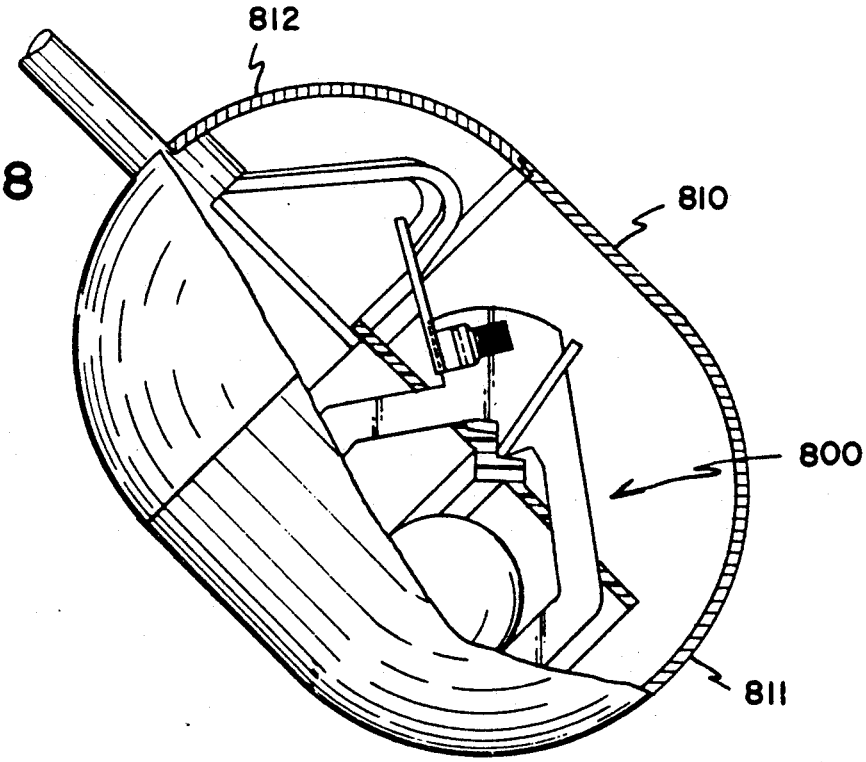
FIG. 28 is an elevational side view of another improved embodiment of the invention showing an additional improved float housing, or switch housing.

Referring now to FIG. 27, an alternative float housing 710 is shown with top 711 and bottom 712. Housing 710 is also designed for compact applications like housing 410. Referring now to FIG. 28, a second alternative float housing 810 is shown. Top 811 and bottom 812 of housing 810 are more spherical than top 111 and bottom 112 shown with the switch 100 in FIGS. 5*a* and 5*b*, top 411 and bottom 412 shown with the switch 400 of FIGS. 12*a* and 12*b*, and top 711 and bottom 712 of housing 710. It is believed that the spherical ends may reduce the ability of sludge to form or attach to the housing 810. While the housing 810 in FIG. 28 has a generally cylindrically shaped midportion with generally spherical ends, it is to be appreciated that a more spherical housing may also be employed.

Referring to FIGS. 13–15, 16*a* and 16*b*, yoke 450 having a U-shape is pivotally mounted above the top 421 of the cage 420. Front 453 and rear 454 legs of the yoke 450 extend into the longitudinal raceway 430 through longitudinal slits 429*a*,429*b* in the top 421 of the cage 420. The legs 453,454 extend a sufficient distance into the longitudinal raceway 430 to insure that the sphere 490 remains between the legs 453,454 at all times. Longitudinal movement of the sphere 490 within the raceway 430 between the front 430*a* and rear 430*e* portions of the raceway 430 causes the sphere to strike the legs 453,454 of the yoke 450 and pivot the yoke between a first pivotable position and a second pivotable position depicted in FIGS. 16*a* and 16*b* and in FIGS. 12*b* and 12*a*.

Yoke 450 of the improved switch 400 preferably also includes an elongate member 469 having an edge 473 for mounting the yoke to the cage. Cage 420 preferably includes an elongate groove 472 having a concave outer surface. The groove 472 receives the edge 473 of the elongate member 469 of the yoke. During movement of the yoke 450 between positions and while in the first and second pivotable positions, the edge 473 rests on the concave outer surface of the groove 472 and defines a pivot axis of the yoke 450.

Switch 100 shown in FIGS. 5–11 employs a radial pivot about center pin 161. Improved switch 400 employs an axial pivot, or edge pivot, about edge 473. The axial pivot is believed to reduce friction and increase life of switch 400 by eliminating the pin pivot.

A pair of transverse springs 470*a*,470*b* are provided to maintain yoke 450 in proper engagement with cage 420 such that edge 473 remains in groove 472 during operation. Springs 470*a*,470*b* function to bias yoke 450 toward cage 420 to maintain edge 473 in groove 472. Springs 470*a*,470*b* also function to bias yoke 450 towards the appropriate first or second pivotable positions. One end of each spring 470*a*,470*b* is coupled to a respective post 471*a*,471*b* located on opposite sides of cage 420. The opposite ends of each spring 470*a* and 470*b* attach to one of two tabs 474*a*,474*b* on opposite sides of an extension of the elongate member 469 of yoke 450. In the preferred embodiment shown in FIGS. 12–15, 16*a*, 16*b*, and 17, elongate member 469 of yoke 450 is a plate shaped member having one of its edges defined by edge 473 and terminating in opposite corners with tabs 474*a*,474*b*.

Figure 17A:
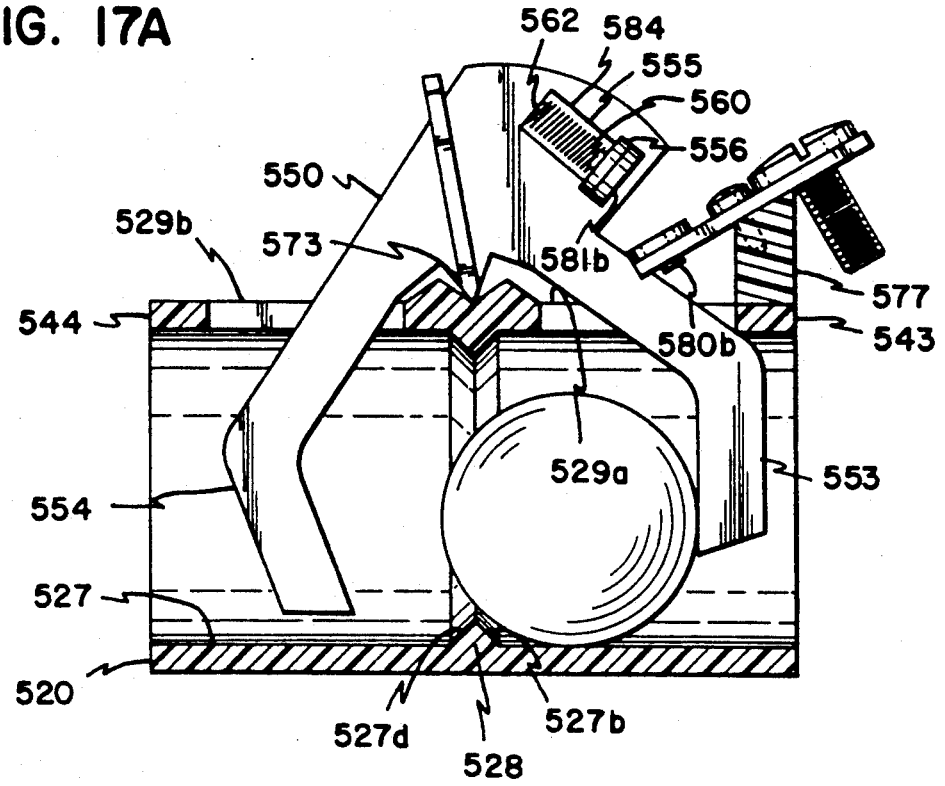
FIG. 17*a* is a cross-section side view of an alternative improved embodiment of a switch showing an alternative embodiment of a yoke and an alternative embodiment of a switch body or cage. The switch is shown in the electrically open position.

FIGS. 17*a* and *b* and FIG. 18 illustrate an alternative embodiment of a yoke 550 for use with an alternative embodiment of cage 520. Yoke 550 is the preferred yoke design. One advantage of yoke 550 is that the elongate member 569 is a plate-shaped member having a trapezoid shape with one of its edges defined by edge 573 and terminating in opposite corners with tabs 574*a* and 574*b*. By defining a trapezoid shape with the smaller end of the trapezoid at the top end of the yoke 550, a more compact design for the switch is possible. In other words, a smaller switch results, thereby reducing the amount of necessary space in the switch housing.

Figure 17B:
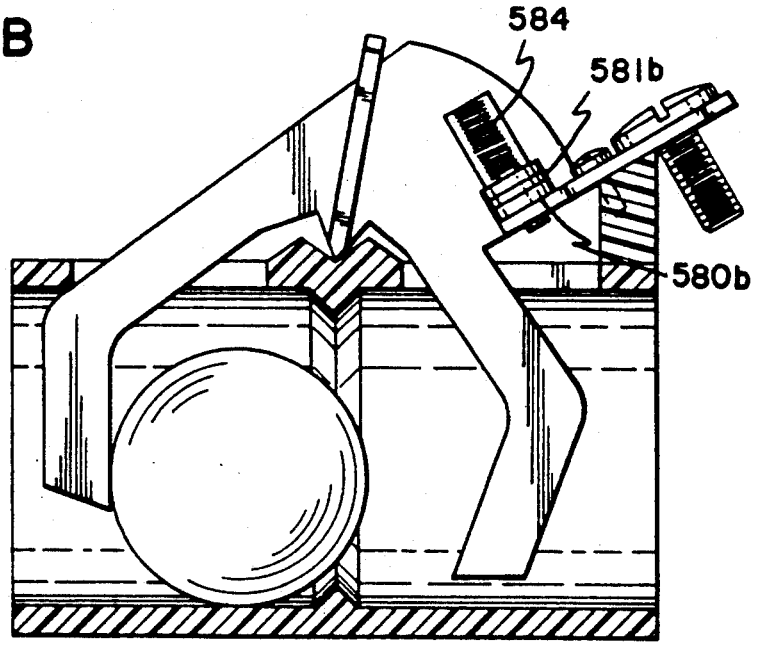
FIG. 17*b* depicts the switch of 17*a* in the electrically closed position.

Cage 520 shown in FIGS. 17*a* and 17*b* is similar in many respects to cage 420. Several differences exist with cage 520 over cage 420. One difference is the shape of the inner surface 527 in the region forming the barrier 528. Instead of curved surfaces on the front inclined surface portion 427*b* and the rear inclined surface portion 427*d*, front inclined surface portion 527*b* and rear inclined surface portion 527*d* have flatter surfaces. Further, portions of the cage 520 form the yoke stops to stop the yoke from continued movement during operation instead of stops 443 and 444 protruding from the housing. Slots 529*a*,529*b* receive yoke arms 553,554, respectively. Front yoke stop 543 and rear yoke stop 544 formed on end portions of slots 529*a*,529*b* engage yoke legs 553 and 554 respectively. This engagement is shown in FIGS. 17*a* and 17*b*.

Referring again to FIGS. 12–16, springs 470*a*,470*b* are positioned with respect to the pivot axis defined by edge 473 so as to provide biasing of the yoke 450 to remain in the first pivotable position when the yoke 450 is in the first pivotable position and biasing of the yoke 450 to remain in the second pivotable position when the yoke 450 is in the second pivotable position. Such a dual biasing effect is obtained by positioning the springs 470*a*,470*b* so that the springs 470*a*,470*b* pass through the pivot axis defined by edge 473 as the yoke 450 moves between the first and second pivotable positions. Referring to FIGS. 14, 15, 16*a*, and 16*b*, the springs 470*a*,470*b* bias the yoke 450 towards the front 423 of the cage 420 when the yoke 450 is in a first pivotable position (springs 470*a*,470*b* to one side of pivot axis 473) and bias the yoke 450 toward the back 424 of the cage 420 while the yoke 450 is in a second pivotable position (springs 470*a*,470*b* on an opposite side of pivot axis 473).

Figure 14:
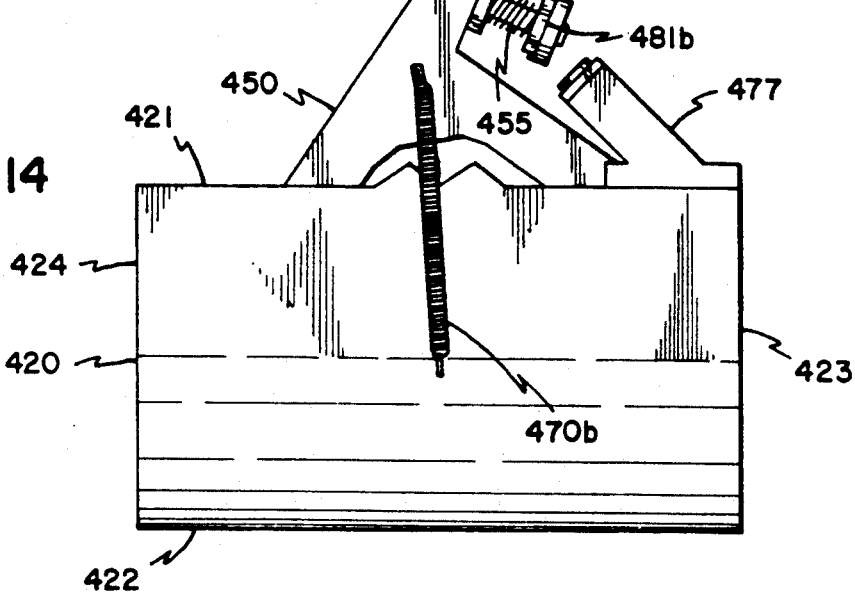
FIG. 14 is a side view of the switch depicted in FIG. 13.
Figure 15:
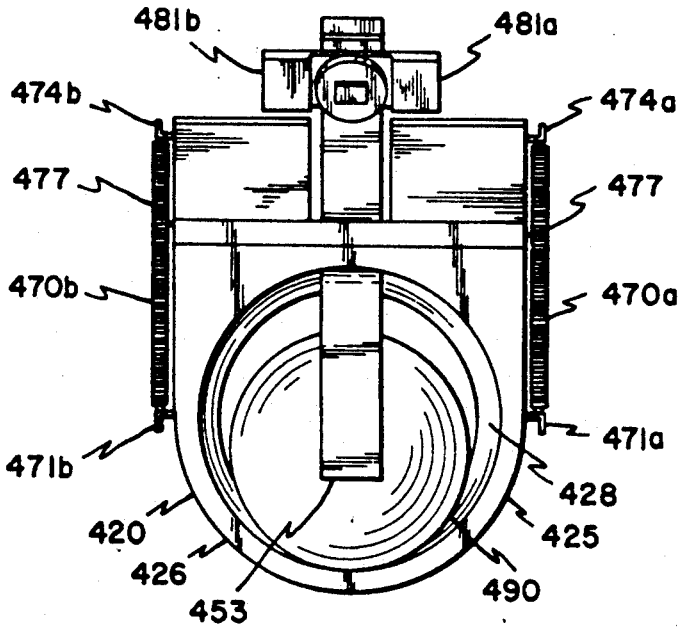
FIG. 15 is a right end view of the switch depicted in FIG. 14.

A front pair of right and left stationary electrical contacts 480*a*,480*b* are mounted upon the top 421 of the cage 420. The front pair of electrical contacts 480*a*,480*b* faces partially toward the rear 424 of the cage 420. As best shown in FIGS. 14, 16*a*, and 16*b*, the front pair of stationary electrical contacts 480a,480b have a contact surface with a generally planar portion facing in a direction at an angle to the longitudinal axis of switch 400. Extension member, or support member 477, extends from cage 420 to position stationary electrical contacts 480a,480b at a spaced apart distance from cage 420. A slightly different configuration for support 577 is shown in FIGS. 17a and 17b.

Support member 477 may be integrally formed with cage 420. In the preferred embodiments, support member 477 is a separate piece attachable to cage 420. By making support 477 as a separate piece, the support 477 can be made from a different material than cage 420 if desireable, and the contacts mounted thereon can be replaced by replacing the support member 477 with another support member configured with different types of contacts or a different number of contacts if desireable for use with cage 420.

A front pair of right and left positionable electrical contacts 481a,481b are mounted upon opposite ends of a lateral extension bar 456 which is slideably positioned on a central projection 455 on yoke 450 and biased in place by spring 484. The front pair of positionable electrical contacts 481a,481b are configured in conjunction with the front pair of stationary electrical contacts 480a,480b so as to provide an electrical connection of the corresponding right 480a,481a and left 480b,481b electrical contacts when the yoke is in one pivoted position and prevent electrical connection of the corresponding left 480a,481a and right 480b,481b electrical contacts with the yoke is in the other pivoted position. The front pair of positionable electrical contacts 481a,481b have a contact surface with a generally planar portion engageable with the contact surfaces of the stationary electrical contacts 480a,480b.

Switch 400 is configured such that the electrical contacts separate and contact in a direction generally perpendicular to the planar surface portions of the contacts. This helps to reduce wiping action of the contacts during contact and separation. In some large electrical loading applications, as are often typical in the case of float switches, excessive wiping action may cause problems with the proper functioning of the switch.

The contacts shown in FIG. 12–16 are square. It is to be appreciated that other shapes, such as round, are possible, as shown in FIG. 18.

The lateral extension bar 456 best shown in FIGS. 13–16 is reciprocally mounted on the center projection 455 of the yoke 450. The spring 484 is provided for biasing the front positionable electrical contacts 481a,481b toward the front stationary electrical contacts 480a,480b. Biasing of the front positionable electrical contacts 481a,481b toward the front stationary electrical contacts 480a,480b assists in assuring electrical contact between the positionable 481a,481b and stationary 480a,480b contacts when the yoke 450 is in the second pivotable position.

Yoke 550 shown in FIGS. 17a,17b and 18 has a different structure for mounting the contacts to the yoke. Electrical contacts 581a and 581b are mounted to yoke 550 by a lateral extension bar 556 which is slideably positioned and maintained in a central opening 555 through yoke 550 for reciprocal movement in the center opening 555 of the yoke 550. The lateral extension bar 556 is held in place by a spring 584. The spring 584 is provided for biasing the front positionable electrical contacts 581a,581b toward the front stationary electrical contacts 580a,580b to assist in assuring electrical contact between the contacts when the yoke 550 is in the second pivotable position. A centering knob 560 on the extension bar 556 and a centering knob 562 on yoke 550 assist in maintaining spring 584 in central opening 555. Stops (not shown) on extension bar 556 engage the edges of central opening 555 on yoke 550 to keep the lateral extension bar 556 from moving transversely to the axis of the cage 520.

It is to be appreciated that the contacts 480a,480b and 481a,481b shown in FIGS. 12–16 could be positioned adjacent the opposite end or rear 424 of switch 400 in a mirror image location on yoke 450 and cage 420 to that depicted in the Figures. For example, switches 700,800 of FIGS. 27 and 28 have contacts mounted on the opposite end. Optionally, contacts could be provided on both ends of switch 400 permitting an end user to connect either set of contacts to the wires of the electrical cord to permit switch 400 to operate as desired by the user. If contacts are positioned in the locations depicted in FIGS. 12a and 12b, the switch contacts are closed when the float housing is in the position shown in FIG. 12a and the contacts are open when the float housing is in the position shown in FIG. 12b. If the contacts are located adjacent the back 424 of cage 420, then the contacts will be open when the float housing is in the position shown by FIG. 12a and in the closed position when the float housing is in the position shown by FIG. 12b. It is also possible to connect up both sets of contacts simultaneously should the end user so desire. It is also anticipated to provide more than one set of contacts on each end of the switch 400 if desired.

As best shown in FIGS. 14, 16a and 16b, the first electrical contacts 480a,480b are located at a greater distance from cage 420 than is the pivot axis of edge 473. In this configuration, greater force can be applied in a direction transverse to the generally planar surface portions of first stationary electrical contacts 480a,480b and first positionable electrical contacts 481a,481b without unnecessarily creating a large switch design. Greater force during pivoting of yoke 450 results in better opening and closing of the electrical contacts. As shown in FIGS. 5–11, switch 100 positions its contacts between pivot axis 161 and cage 120 in a more tightly confined space than in switch 400.

As illustrated in FIGS. 4, 5a, and 5b for switch 100, the switch 400 of FIGS. 12–16 is also connectable to the first electrical cord 220 with the live wire coupled to the left front stationary electrical contact 480a and the return wire connected to the right front stationary electrical contact 480b. Flow of electricity is provided from the live wire to the return wire so as to complete the electrical circuit by simultaneously coupling the front left stationary electrical contact 480b to the left positionable electrical contact 481b and the front right stationary electrical contact 480a to the right positionable electrical contact 481a. Such coupling of the front electrical contacts 480a,480b,481a,481b permits electricity to sequentially flow from the live wire to the return wire through (i) the front left stationary electrical contact 480b, (ii) the front left positionable electrical contact 481b, (iii) the lateral extension bar 456, (iv) the front right positionable electrical contact 481a, and (v) the front right stationary electrical contact 480a.

The cage 420 and yoke 450 may be constructed from substantially any structural material possessing sufficient structural integrity regardless of electrical conductivity including specifically, but not exclusively, plastics such as polyester and polyvinyl chloride and metal such as aluminum and steel. In the preferred embodiments, the yoke is made from a material that has high impact resistant properties to provide additional life for the switch. One plastic that is anticipated for use in manufacturing the yoke is a polycarbonate plastic. A material for use in manufacturing support 477 for attaching the stationary contacts to the cage is preferably a plastic that performs well under high temperatures that may exist during operation of the switch. One anticipated material for the support 477 is a polycarbonate plastic, the same preferred material to make the yoke. The cage itself is preferably made from polyvinyl chloride. Further,. the switch housing 410 is also preferably made from polyvinyl chloride.

In the preferred embodiment, proper functioning of the improved switch 400 requires that the force exerted upon the yoke 450 by the sphere 490 in the longitudinal direction when the sphere 490 strikes one of the legs 453,454 will always be sufficient to overcome a combination of the biasing force applied to the yoke 450 by the springs 470*a*,470*b* and the frictional forces and gravitational forces acting upon the yoke 450. As noted above, in the preferred embodiment of the switch 400, the weight of the sphere 490 alone is sufficient to overcome these biasing and frictional and gravitational forces acting on the yoke 450. It is to be appreciated that some additional forces are applied to yoke 450 in addition to the force applied by the weight of the sphere, including forces resulting from the sphere traveling from the barrier 428 until contacting and moving yoke 450 from one position to the other. However, the sphere 490 is capable of repositioning the yoke 450 based solely on weight of the sphere in the preferred embodiment, and preferably sphere 490 should be constructed from a fairly dense material such as steel or iron.

The improved switch 400 operates similarly to the switch 100 illustrated in FIGS. 1-11. A liquid level within the reservoir which is at or below the bottom of the pumping range causes switch 400 to occupy a downward position such as depicted in FIG. 12*b*. In the downward position of FIG. 12*b*, the switch 400 is electrically open. Sphere 490 is retained within the front retention portion 430*a* of the raceway 430. The yoke 450 is in the first pivotable position towards the front 423 of the cage 420. The springs 470*a*,470*b* bias the yoke toward the front 423 of the cage 420. As the liquid level increases, the raceway 430 angles upward past horizontal until the sphere 490 rolls toward the rear 424 of the cage 420 and into contact with the front inclined surface 427*b* of barrier 428. Further increases in the liquid level causes switch 400 to reach the top of the pumping range at which time the sphere rolls over the front inclined surface 427*b* and over 427*c* of barrier 428, and into contact with the rear leg 454 of the yoke 450 so as to pivot the yoke 450 past a transitional position, and into the rear retention portion 430*e* of the raceway 430. Once the yoke has been pivoted past the transitional pivot position, the yoke 450 is moved into the second pivotable position. The springs are then positioned to bias the yoke toward the rear 424 of the cage 420 and into the second pivotable position. In the second pivotable position, the switch 400 is electrically closed with the front positionable electrical contacts 481*a*,481*b* coupled to the front stationary electrical contacts 480*a*,480*b* and retained in the closed position by springs 470*a*,470*b*.

Movement of the switch 400 from electrically closed to electrically opened is simply a reverse of the described sequence with the sphere 490 moving from the rear retention portion 430*e* of the raceway 430 to the front retention portion 430*a* and the yoke pivoting from the second pivotable position proximate the rear 424 of the cage 420 to the first pivotable position proximate the front 423 of the cage 420.

Figure 22:
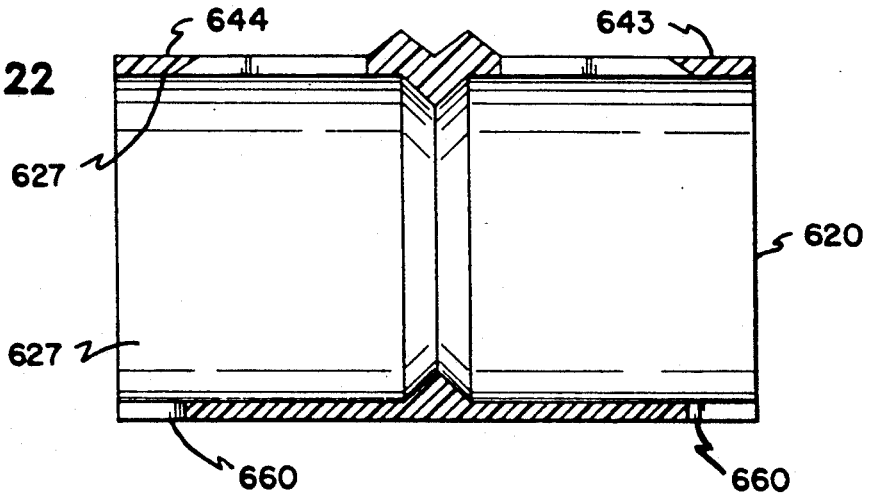
FIG. 22 is a cross-sectional side view of the cage shown in FIG. 21 taken along lines 22—22.
Figure 23:
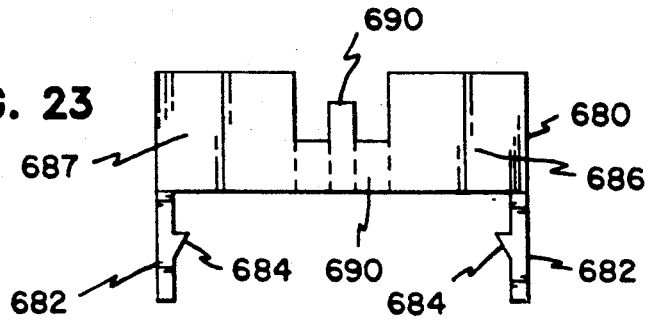
FIG. 23 is a right end view of an alternative improved embodiment of a contact block mountable to the cage depicted in FIGS. 19-22.
Figure 24:
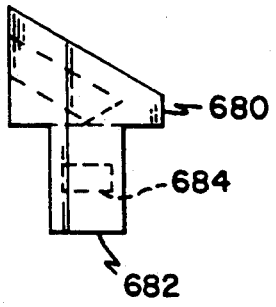
FIG. 24 is a side view of the contact block depicted in FIG. 23.
Figure 25:
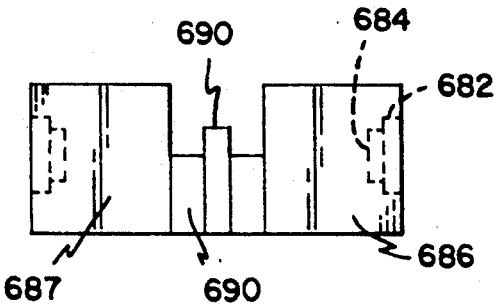
FIG. 25 is a top view of the contact block depicted in FIG. 24.
Figure 26:
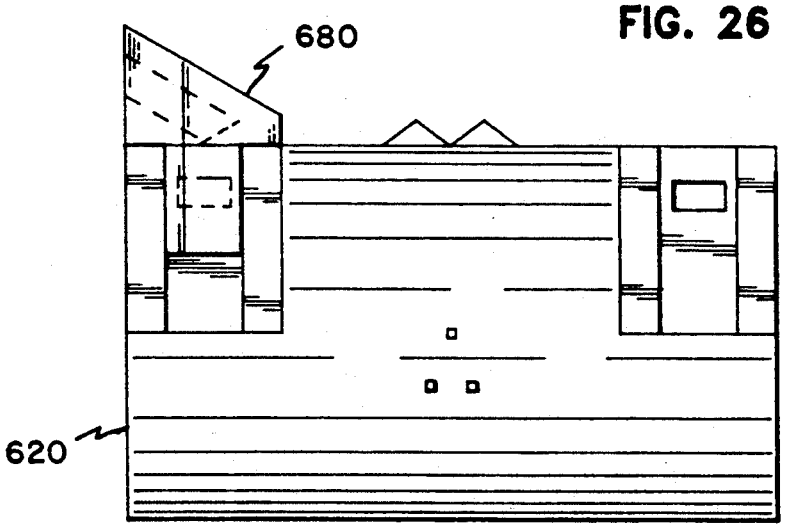
FIG. 26 is a side view of the cage depicted in FIG. 20 with the contact block depicted in FIG. 23 mounted to the cage.
Figure 29:
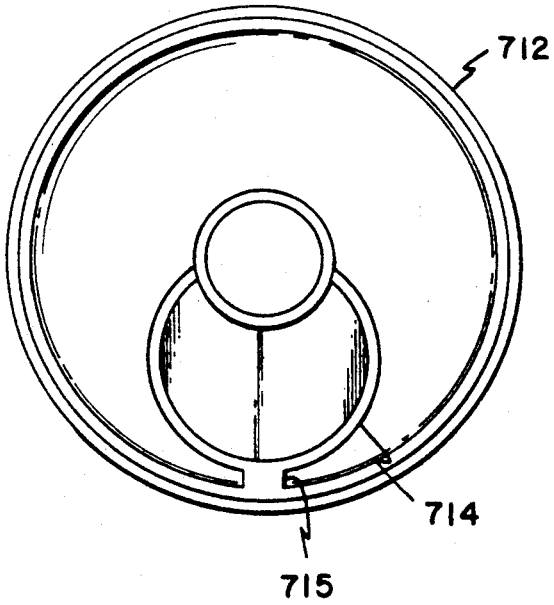
FIG. 29 is an end view of the bottom half of the switch housing shown in FIG. 27, showing the internal structure of the switch housing for mounting to the cage.

Additional improvements have been made and are depicted in FIGS. 19-28. Some of the further improvements have already been noted above. FIGS. 19-22 illustrate a further alternative improved switch body or cage 620. FIGS. 23-25 show an alternate improved contact block 680 which is mountable to cage 620 as is shown in FIG. 26. Contact block 680 provides an alternative structure to the structures previously shown for positioning the stationary contacts on the cage. FIGS. 27-29 show additional improvements to the float housing or switch housing.

Referring in particular to FIGS. 19-21 and FIGS. 23-25, the particular improvements will be discussed. One addition to cage 620 not present in previous embodiments is a right and left wire post 672*a*,672*b*. The wire posts 672*a*,672*b* are located offset and below right spring post and left spring post 671*a*,671*b*. The wire posts are offset from the vertical to facilitate ease of molding of the cage 620. Only one wire post per side may be employed if desired. The spring post 671*a*,671*b* permit attachment of the springs to the cage 620. The wire posts 672*a*,672*b* provide structure for holding the wires away from the yoke to prevent the wires from interfering with the operation of the yoke. The wire posts 672*a*,672*b* are used when the contacts are mounted adjacent the top 411 of switch housing 410 as is shown in FIGS. 12*a* and 12*b*. The wires posts 672*a*,672*b* would not likely be necessary when the contacts were mounted adjacent the bottom end 412 of switch housing 410. Positioning of the switch contacts adjacent the bottom end of the switch housing is shown in FIGS. 27 and 29.

As best shown in FIG. 22, cage 620 includes angled stops 643 and 644. The angled stops 643,644 provide surface to surface engagement with the yoke during operation. In contrast, the cage 520 in FIGS. 17*a* and 17*b* is provided point to surface contact between the yoke stops 543,544 and the yoke legs 553,554.

Various means for attaching the stationary contacts to the cage are anticipated. FIGS. 19-25 illustrate a preferred method of attaching the contacts to the cage. Contact block 680 shown in FIGS. 23-25 provides right and left contact mounting regions 686,687. The actual contacts are not shown in the Figures. However, any of a variety of known contacts may be used with contact block 680. In addition, structure is also provided to attach the wires to the contacts. This structure is not shown in FIGS. 23-25. However, it is anticipated that any of a variety of known techniques for attaching wires to the contacts may be provided such as is illustrated in previous embodiments.

Contact block 680 includes two legs 682. Each leg includes a tab 684 extending inwardly. Cage 620 includes at least two contact block slots 650 for receiving legs 682 of the contact block 680. Two notches, or depressions 652, are provided in the contact block slot 650. Each notch 652 receives one of the tabs 684 of the contact block 680 to releasably lock the contact block 680 to cage 620 as is best shown in FIG. 26.

Because contact block 680 is easily attachable to cage 620, and further is easily releasable from cage 620, different contact blocks 680 may be used with cage 620. For example, different contact blocks may be used if different temperature ranges are desired. In addition, different contact blocks may be used if different contacts are desired. Also, a second contact block may be provided if additional contacts are necessary. As shown in FIGS. 19–21, cage 620 includes identical structure on both ends for receiving two contact blocks 680 simultaneously.

Referring again to FIGS. 23–25, one feature shown with contact block 680 not identified with previous embodiments relates to the problem of electrical failure wherein an electrical connection is made between the stationary contacts positioned on the contact block 680 along the surface of the contact block when the contacts are not engaged by the movable contacts positioned on the yoke. Such breakdown could occur along a flat surface of the contact block 680 between the two stationary contacts positioned one in each contact mounting region 686,687. A structure of contact block 680 that may decrease the likelihood of electrical failure in this manner is to provide contact block 680 with a convoluted pathway surface 690 between the contact mounting regions 686,687. By providing the convoluted pathway surface 690, the distance between the contacts is increased, making electrical failure less likely.

FIG. 27 illustrates switch 700 with an improved cylindrical switch housing 710 having a top end 711 and a bottom end 712. The exterior of the switch housing 710 provides a small area for use in applications emphasizing small size of the switch and switch housing. Switch housing 710 is usable with several of the switches disclosed above. In FIG. 28, switch 800 is positioned in switch housing 810 which has a spherical top end 811 and a spherical bottom end 812 connected by generally cylindrical mid portion. It is anticipated that switch 800 could also be any of a variety of switches of the types disclosed above. To reduce the possibility of corrosion to the internal parts, a corrosion inhibitor may be utilized inside the switch housing 710,810.

Referring now to FIG. 29, one method of attaching the switch to the switch housing is shown. In FIG. 29 the bottom end 712 of the switch housing 710 is shown in greater detail. Shown in FIG. 29 is the preferred mounting structure on switch housing 710 which provides a convenient method of easily attaching switch 700 to the switch housing 710. The bottom end 712 includes an alignment guide 714 having a generally C-shaped cross-section and extending outward from the bottom end 712. The alignment guide 714 fits within the end of switch 700 to engage a portion of the inner surface of the cage of the switch 700. Cage 620 shown in FIGS. 19–22 is usable with switch housing 710. The alignment guide 714 would engage the end surface portion of inner surface 627 of cage 620. To further assist in aligning the switch with the housing, a key 715 is provided to engage notch or mounting slot 660 on cage 620. It is anticipated that various means for further attaching the switch to the switch housing are possible including glue or other adhesive means.

The specification is intended to aid in a complete non-limiting understanding of the invention. Since many variations and embodiments of the invention may be created without departing from the spirit and scope of the invention, the scope of the invention resides in the claims hereinafter appended.

We claim:

1. A switch used in a float switch system, the switch being float actuated, the switch comprising:

a cage having an inner surface defining a longitudinal raceway, the cage further having an outer surface;

a first electrical contact;

means mounting the first electrical contact to the cage, said first contact movable between a first position and a second position relative to the cage;

an electrical contact block, the electrical contact block including two inwardly opposing biased tabs, and the cage including two notches facing in generally opposite directions on opposing sides of the outer surface of the cage, each notch receiving one of the tabs, the tabs and the notches cooperating to mount the electrical contact block to the cage;

a second electrical contact mounted to the electrical contact block; and means positioned in the raceway for urging the first electrical contact between the first and second positions to make or break electrical contact between the first and second electrical contacts based upon the longitudinal angle of the raceway.

2. The switch of claim 1, further comprising a third electrical contact which is mounted to the cage for simultaneous movement with the first electrical contact relative to the cage, the switch further comprising a fourth electrical contact mounted on the electrical contact block, the fourth electrical contact making and breaking electrical contact with the third electrical contact, the contact block including an outer surface between the second electrical contact and the fourth electrical contact defining a non-linear surface, wherein the distance along the outer surface between the second electrical contact and the fourth electrical contact is greater than the linear distance between the second electrical contact and the fourth electrical contact.

3. The switch of claim 1, wherein the cage comprises a first material with a first temperature rating, and the electrical contact block comprises a second material having a different temperature rating than the first material.

4. The switch of claim 3, further comprising a float housing, the float housing defining a substantially enclosed interior for containing the cage and the yoke, the float housing being movable to actuate the float switch system during operation.

5. A switch used in a float switch system, the switch being float actuated, the switch comprising:

a cage defining a longitudinal raceway;

a yoke pivotally mounted to the cage and having first and second legs which extend into the raceway, the yoke pivotally movable between a first position and a second position, the yoke including an elongate member having an edge, the edge defining a pivot axis of the yoke, and the cage including an elongate groove having a generally concave outer surface, the groove receiving the elongate member wherein the edge of the elongate member rests on the outer surface of the groove;

electrical switching means which is electrically open when the yoke is in the first position and electrically closed when the yoke is in the second position; and means positioned in the raceway to engage the first and second yoke legs for urging the yoke between the first and second positions based upon the longitudinal angle of the raceway.

6. The switch of claim 5, further comprising biasing means biasing the edge of the elongate member of the yoke against the outer surface of the groove of the cage.

7. The switch of claim 5, wherein the means for urging the yoke between the first and second positions is a sphere and the raceway has a substantially circular cross-section in the longitudinal direction.

8. The switch of claim 7, wherein the cage includes a barrier separating the cage into first and second compartments, the first and second legs of the yoke being positioned in a respective one of the first and second compartments, the barrier having a height preventing movement of the sphere from one of the first or second compartments to the other of the first or second compartments when the longitudinal angle of the raceway is less than or equal to a threshold angle, the barrier permitting movement of the sphere when the longitudinal angle is greater than the threshold angle.

9. The switch of claim 6, wherein the electrical switching means is a first stationary electrical contact mounted to the cage and a second pivotable electrical contact mounted to the yoke.

10. The switch of claim 9, wherein at least one of the electrical contacts is biased towards the other.

11. The switch of claim 6, wherein the biasing means is a spring which passes through the pivot axis of the yoke as the yoke pivots between the first and second positions.

12. The switch of claim 5, further comprising a float housing, the float housing defining a substantially enclosed interior for containing the cage and the yoke, the float housing being movable to actuate the float switch system during operation.

13. A switch used in a float switch system, the switch being float actuated, the switch comprising:

a cage defining a longitudinal raceway;

a yoke pivotally mounted to the cage and having first and second legs which extend into the raceway, the yoke pivotally movable between a first position and a second position, the yoke including an elongate member having an edge, and the cage including an elongate groove having a generally concave outer surface, the groove receiving the elongate member wherein the edge of the elongate member rests on the outer surface of the groove;

biasing means capable of biasing the yoke in a first direction when the yoke is in the first position and biasing the yoke in a second direction, which is substantially diametrically opposed to the first direction, when the yoke is in the second position, the biasing means further biasing the edge of the elongate member of the yoke against the outer surface of the groove of the cage;

electrical switching means which is electrically open when the yoke is in the first position and electrically closed when the yoke is in the second position; and means positioned in the raceway to engage the first and second yoke legs for urging the yoke between the first and second positions against the bias of the biasing means based upon the longitudinal angle of the raceway.

14. The switch of claim 13, wherein the biasing means includes at least one spring mounting the yoke to the cage.

15. The switch of claim 14, wherein the spring passes through a pivot axis of the yoke as the yoke pivots between the first and second positions.

16. The switch of claim 13, wherein the means for urging the yoke between the first and second positions is a sphere and the raceway has a substantially circular cross-section in the longitudinal direction, and wherein the cage includes a barrier separating the cage into first and second compartments, the first and second legs of the yoke being positioned in a respective one of the first and second compartments, the barrier having a height preventing movement of the sphere from one of the first or second compartments to the other of the first or second compartments when the longitudinal angle of the raceway is less than or equal to a threshold angle, the barrier permitting movement of the sphere when the longitudinal angle is greater than the threshold angle.

17. The switch of claim 16, wherein the sphere has a weight greater than or equal to a weight sufficient to urge the yoke between the first and the second positions against the biasing means when the longitudinal angle of the raceway is greater than the threshold angle.

18. The switch of claim 13, wherein the electrical switching means is a first stationary electrical contact mounted to the cage and a second pivotable electrical contact mounted to the yoke.

19. The switch of claim 13, further comprising a float housing, the float housing defining a substantially enclosed interior for containing the cage and the yoke, the float housing being movable to actuate the float switch system during operation.

20. A switch used in a float switch system, the switch being float actuated, the switch comprising:

a cage defining a longitudinal raceway having a substantially circular cross-section in the longitudinal direction;

a yoke pivotally mounted to the cage and having first and second legs which extend into the raceway, the yoke pivotally movable between a first position and a second position;

biasing means capable of biasing the yoke in a first direction when the yoke is in the first position and biasing the yoke in a second direction, which is substantially diametrically opposed to the first direction, when the yoke is in the second position;

electrical switching means which is electrically open when the yoke is in the first position and electrically closed when the yoke is in the second position;

a sphere positioned within the raceway, the sphere contacting one of the first and second yoke legs to urge the yoke between the first and second positions against the biasing of the biasing means based upon the longitudinal angle of the raceway; and a wedge-shaped barrier defining an annular shape on an interior surface of the raceway, the barrier separating the raceway into first and second compartments, the barrier having a height preventing movement of the sphere from one of the first or second compartments to the other of the first or second compartments when the longitudinal angle of the raceway is less than or equal to a threshold angle, the barrier permitting movement of the sphere when the longitudinal angle is greater than the threshold angle.

21. The switch of claim 20, wherein the sphere has a weight greater than or equal to a weight sufficient to urge the yoke between the first and the second positions against the biasing means when the longitudinal angle of the raceway is greater than the threshold angle, wherein the sphere moves across the barrier from one of the first or second compartments to the other of the first or second compartments when the threshold angle is exceeded and wherein the sphere first contacts one of the first and second legs of the yoke in the other of the first or second compartments while the sphere is in contact with the barrier.

22. The switch of claim 20, further comprising a float housing, the float housing defining a substantially enclosed interior for containing the cage and the yoke, the float housing being movable to actuate the float switch system during operation.

* * * * *